US009045321B2

(12) United States Patent
Ford et al.

(10) Patent No.: US 9,045,321 B2
(45) Date of Patent: Jun. 2, 2015

(54) LOAD TRANSPORT SYSTEM AND METHOD

(75) Inventors: Don Ford, Ragley, LA (US); Roger Boyette, Lake Charles, LA (US); Reggy Saxon, Lake Charles, LA (US); Ian Foxton, Dequincy, LA (US); James Montie, Sulphur, LA (US)

(73) Assignee: Recon Engineering, Inc., Sulphur, LA (US)

( * ) Notice: Subject to any disclaimer, the term of this patent is extended or adjusted under 35 U.S.C. 154(b) by 787 days.

(21) Appl. No.: 12/930,545

(22) Filed: Jan. 10, 2011

(65) Prior Publication Data

US 2011/0206489 A1 Aug. 25, 2011

Related U.S. Application Data

(60) Provisional application No. 61/335,966, filed on Jan. 15, 2010.

(51) Int. Cl.

| | |
|---|---|
| ***B66F 9/16*** | (2006.01) |
| ***B66F 9/075*** | (2006.01) |
| *B66F 9/06* | (2006.01) |

(52) U.S. Cl.

CPC ..... *B66F 9/07563* (2013.01); *B66F 9/06* (2013.01); *B66F 9/07513* (2013.01)

(58) Field of Classification Search

USPC ..... 414/628, 629, 630, 631, 632, 637, 639, 414/640, 641, 642, 458; 187/222, 224, 226, 187/229, 230, 233, 234, 236, 237, 238

See application file for complete search history.

(56) References Cited

U.S. PATENT DOCUMENTS

| | | | | | |
|---|---|---|---|---|---|
| 342,950 | A | | 6/1886 | Caldwell | |
| 1,799,307 | A | | 4/1931 | Manley | |
| 2,804,174 | A | | 8/1957 | Chasar | |
| 2,899,093 | A | | 8/1959 | Morrell | |
| 2,918,143 | A | | 12/1959 | Shaffer | |
| 2,925,887 | A | * | 2/1960 | Gibson | 187/232 |
| 3,051,265 | A | | 8/1962 | Boyajian et al. | |
| 3,057,426 | A | * | 10/1962 | Hastings, Jr. | 180/255 |
| 3,080,019 | A | * | 3/1963 | Hastings, Jr. | 187/224 |
| 3,098,543 | A | * | 7/1963 | Hastings, Jr. | 187/224 |
| 3,489,249 | A | | 1/1970 | Stammen | |
| 3,937,294 | A | | 2/1976 | Haddock | |
| 4,287,966 | A | | 9/1981 | Frees | |

(Continued)

FOREIGN PATENT DOCUMENTS

| | | | |
|---|---|---|---|
| DE | 20213322 | U1 | 3/2003 |
| EP | 726224 | A2 | 8/1996 |

(Continued)

*Primary Examiner* — Saul Rodriguez
*Assistant Examiner* — Glenn Myers
(74) *Attorney, Agent, or Firm* — Shultz & Associates, P.C.

(57) ABSTRACT

A motorized means of transporting loads includes a fork lift mechanism that features a set of anchored chains fitted to a set of lifting forks for lifting and lowering a load. With a combination electrical/hydraulic system, the lifting and lowering functions can be efficiently obtained. Two load supporting outriggers are provided which can be extended or retracted while transporting a load to aid in navigating constricted spaces. A tilting mast and fork assembly allows for a manipulation of the center of gravity while transporting loads. A joystick function controls the forward, turning, reverse, lifting, and extending and retracting the outriggers. A battery enabled transport provides for flash charging of the onboard batteries to extend useful life.

4 Claims, 22 Drawing Sheets

(56) References Cited

U.S. PATENT DOCUMENTS

| | | | | | |
|---|---|---|---|---|---|
| 4,395,189 | A | * | 7/1983 | Munten | 414/635 |
| 4,413,708 | A | * | 11/1983 | Stedman | 187/222 |
| 4,571,139 | A | | 2/1986 | Moseley et al. | |
| 4,657,471 | A | * | 4/1987 | Shinoda et al. | 414/663 |
| 4,708,577 | A | * | 11/1987 | Fratzke | 414/635 |
| 5,121,816 | A | | 6/1992 | Curtin | |
| 5,174,415 | A | * | 12/1992 | Neagle et al. | 187/234 |
| 5,238,086 | A | * | 8/1993 | Aoki et al. | 187/223 |
| 5,575,605 | A | | 11/1996 | Fisher | |
| 5,586,620 | A | * | 12/1996 | Dammeyer et al. | 187/227 |
| 5,752,584 | A | | 5/1998 | Magoto et al. | |
| 5,879,124 | A | * | 3/1999 | Brouwer et al. | 414/631 |
| 6,112,612 | A | | 9/2000 | Seksaria et al. | |
| 6,137,398 | A | | 10/2000 | Dunlap et al. | |
| 6,203,263 | B1 | * | 3/2001 | Hancock | 414/458 |
| 6,241,047 | B1 | | 6/2001 | Gilliland et al. | |
| 6,343,674 | B1 | * | 2/2002 | Sexsmith | 187/222 |
| 6,382,359 | B1 | | 5/2002 | Lohmann | |
| 6,530,740 | B2 | | 3/2003 | Kim | |
| 6,601,825 | B2 | | 8/2003 | Bressner et al. | |
| D492,833 | S | | 7/2004 | Henshaw et al. | |
| 6,921,095 | B2 | | 7/2005 | Middleby | |
| 6,971,470 | B2 | * | 12/2005 | McGoldrick | 180/321 |
| D544,174 | S | | 6/2007 | Quinlan et al. | |
| D544,673 | S | | 6/2007 | Quinlan et al. | |
| 7,267,369 | B2 | | 9/2007 | Gallagher et al. | |
| 7,314,116 | B2 | | 1/2008 | David et al. | |
| D562,525 | S | | 2/2008 | Graf et al. | |
| 7,328,810 | B1 | * | 2/2008 | Rhodes | 212/180 |
| D565,270 | S | | 3/2008 | Ruppert et al. | |
| 7,597,522 | B2 | | 10/2009 | Borntrager et al. | |
| D608,074 | S | | 1/2010 | Berger et al. | |
| D608,521 | S | | 1/2010 | Berger et al. | |
| 7,658,259 | B2 | | 2/2010 | Smiley et al. | |
| 8,167,528 | B2 | * | 5/2012 | Keeven et al. | 414/642 |
| 8,777,545 | B2 | * | 7/2014 | Roux | 414/631 |
| 2003/0221914 | A1 | | 12/2003 | Smith et al. | |
| 2004/0083025 | A1 | | 4/2004 | Yamanouchi et al. | |
| 2008/0202857 | A1 | | 8/2008 | Waltz et al. | |
| 2008/0202858 | A1 | | 8/2008 | Borchers et al. | |
| 2008/0224433 | A1 | | 9/2008 | Setzer et al. | |
| 2008/0308335 | A1 | | 12/2008 | Anderson et al. | |
| 2009/0020369 | A1 | | 1/2009 | Warachka | |
| 2009/0041564 | A1 | | 2/2009 | Borntrager et al. | |
| 2009/0198416 | A1 | | 8/2009 | Wetterer et al. | |

FOREIGN PATENT DOCUMENTS

| | | | |
|---|---|---|---|
| GB | 895172 | A | 5/1962 |
| WO | WO03066408 | A1 | 8/2003 |

* cited by examiner

LOAD TRANSPORT SYSTEM AND METHOD

CROSS-REFERENCE TO RELATED APPLICATIONS

This application claims priority to Provisional Patent Application No. 61/335,966 filed on Jan. 15, 2010.

TECHNICAL FIELD OF THE INVENTION

This invention relates to fork lifts, hand trucks and other apparatus for lifting a load and transporting it.

BACKGROUND OF THE INVENTION

A prior art load transport system is shown in FIG. 1. The prior art system includes product trailer 101 pulled by tractor 102. Attached to the front of tractor 102 is hand truck 103. Set of roll-up doors 104 are provided on the product trailer to access product stored on shelves inside. Hand truck 103 is sometimes mounted onto the back of the product trailer.

In a typical prior art approach, the product trailer is loaded at the distribution center with pallets of product. The driver follows a predetermined route based on the order in which the pallets were loaded. On arrival at one of the retail stores, the driver removes the hand truck from its mount. The driver opens the roll up door to access the correct pallet. The driver manually loads the product onto the hand truck. Depending on the load, the driver may have to climb in the bay to reach the correct product. The driver then manipulates the hand truck underneath the stacks of boxes and cartons on the ground before moving them into the retail store. Once the driver has a sufficient amount of product on the hand truck he moves it to a staging area in the retail store. The driver continues to load and move the product into the retail store until the order is complete. The driver restocks the shelves and then moves any remaining delivered product to a storage location in the retail store. The driver removes the hand truck and secures it to the truck. When boxes are stacked beyond a certain point a step stool or built-in steps in the truck will allow the driver to reach the more highly placed boxes. Thus, utilizing the prior approach, the driver will physically handle each component of product (e.g. case) four times before stocking is complete.

To compensate for fatigue, the driver/loader will often begin the day by unloading boxes and cartons from near the top of the product trailer and end the day by unloading boxes and cartons near the floor. The unloading process thus requires that the distribution center stack each pallet, by retail location need, from bottom to top as required by the product transport run for the day.

There are a number of problems with the typical prior art approach. A first problem is that the driver or loader places excessive strain on his back, and on leg and arm muscles when reaching up and out to retrieve heavy boxes and cartons from within the product trailer. Considerable strain is also experienced when placing the heavy boxes and cartons on the ground and when loading or unloading inside the retail store. Hence, the prior art approach is injury prone. Considerable liability insurance is required to protect drivers as a result.

A second problem is that the driver must manually manipulate the cartons and boxes into the retail store using the hand truck. Many times there are significant inclines to be traversed in moving the hand truck from outside to inside the retail store environment. The hand truck and product must be moved through constricted door and walk ways. Many times the walkways are severely inclined or include steps.

A third problem is that the product trailer must be unloaded from top to bottom, in order, so that any changes to the nm for the day will result in additional manual manipulation of materials, costing time and effort. Additional manipulation of product generally increases product damage and loss. It is preferable to provide the driver a means by which to access and more easily remove different product at different times from the trailer.

It is then desirable to reduce injury, potential liability and product loss in unloading and moving product from a product truck to a storage location. Therefore, a mechanism is needed to manipulate heavy boxes and cartons of product trailers.

The prior art has thus far not successfully met the need. For example, U.S. Pat. No. 6,921,095B2 to Middleby discloses a hand trolley that includes a chassis formed from side frames comprising parallel frame members, wheels and a base platform provided with a load lifting carriage having a lifting surface. The carriage can be raised from a low position on the base platform to an elevated position by operating a hand winch. However, the repeated use of a hand winch does not eliminate the risk of injury.

As another example, U.S. Pat. No. 6,530,740B2 to Kim et al. disclose a hand truck with an electrically operated lifting platform. The hand truck includes a frame on both sides of which two guide rails are formed. The frame is provided with a threaded shaft vertically supported on the frame to be vertically moved, one or more stabilizing bars forwardly extended from the frame, and two wheels rotatably attached to the rear portion of the frame. However, Kim et al. do not disclose a method of manipulating the frame through constricted doorways or inclined walkways.

U.S. Publication No. 2008/0224433A1 to Setzer et al. disclose a hand truck comprising a powered lifting/lowering tray and controller. The control unit is configured for causing a tray to rise and lower as desired. A scale is mechanically associated with the tray for measuring the weight of an item placed on the scale. However, no provision is made for carrying the hand truck by a vehicle or reconfiguring the hand truck during operation.

U.S. Pat. No. 6,601,825 to Bressner discloses a lifting device. The lifting device enables adaptation for objects of varying size. The lifting device includes a mast separable into a plurality of sections and a pulley supported by a first section of the mast. However, Bressner discusses no way to ease the burden of lifting and stacking product.

U.S. Pat. No. 5,575,605 to Fisher discloses a collapsible, wheeled shopping cart having a horizontal shelf which is vertically movable for loading. The movable shelf may be automatic and movable upwardly when the load on the shelf is decreased or is selectively movable upwardly by a hand crank of a threaded jack or by a piston and cylinder assembly powered by a source of compressed fluid, but Fisher does not eliminate or reduce the possibility of injury due to loading or unloading.

EP Application No. 0726224 to Berg discloses a drum lifting and transporting device. The device has a wheeled frame which stands in an upright position and has vertically moveable drum clamp. A pair of front legs extend generally forwardly and outwardly from the frame. However, Berg also fails to provide a solution for negotiating constricted doorways, walkways or inclines.

The prior art fails to disclose or suggest a mobile load transporter useful for loading and unloading product trucks and similar delivery trucks while being adaptable to various walkways and doorways and while also providing ease of attachment to a vehicle for transport.

SUMMARY OF INVENTION

The present embodiments describe is a load transporter suitable to transport product cases from a product delivery truck into a retail store. Other embodiments are conceived for loading, unloading and transporting many types of loads in the context of delivery trucks and fork lifts suitable for warehouses, factories, and narrow areas such as corridors, elevators, walk-in coolers and retail doorways.

The preferred embodiment load transporter comprises a frame assembly, a mast assembly, a fork assembly and a sheet metal assembly.

The frame assembly comprises a frame to which front arms are movably attached via a pair of actuators. The actuators allow for lateral expansion of the front arms. A left wheel motor with left rear wheel attached is fastened to the left side of the frame assembly. A right wheel motor with right rear wheel attached is fastened to the right side of the frame assembly. Front left and front right wheel assemblies are attached to the left and right arms, respectively, for support of the load and forward stabilization during transport.

The mast assembly is rotatably attached to the frame assembly at a pivot point near the lower front of the frame assembly. The mast assembly is further attached to the frame assembly by left and right mast actuators rotatably fastened near the top of the frame assembly and rotatably fastened to the mast assembly. The mast assembly can be tilted from about three (3) degrees behind vertical to about ten (10) degrees forward of vertical via the left and right mast actuators, to aid in adjusting the center of gravity of the machine during transport of a load.

The mast assembly comprises a telescoping frame movably attached to a lower mast frame. The telescoping frame includes a pair of telescoping channels. The lower mast frame includes a pair of mast channels. The pair of telescoping channels is constrained to move vertically within the pair of mast channels by a set of mast roller bearings traveling within the set of telescoping channels.

The fork assembly comprises a fork frame to which a left and a right fork are rotatably attached. The fork assembly includes a pair of stops to limit the rotation of the left and right forks. The fork assembly is movably attached to the pair of telescoping channels. The fork assembly is constrained by a pair of upper stops attached to the pair of mast channels and a pair of lower stops attached to the pair of telescoping channels. The fork assembly further includes a hydraulic fork lift actuator, fastened at one end to the lower mast frame and fastened at the other end to a fork chain pulley assembly. The fork chain pulley assembly also includes a pair of pulleys. A pair of chains engage the pair of pulleys. The chains are attached to the fork assembly to the lower mast frame. In an alternate embodiment, the left and right forks are attached so as to slide laterally into position onto the fork assembly.

The sheet metal assembly which is attached to the frame assembly supports working components of the load transporter in addition to offering protection from the elements.

An electrical control system is electrically connected to the left and right wheel motors. The hydraulic control system is electrically connected to a set of directional control valves driving the left and right mast tilt actuators, the left and right arm actuators and the hydraulic fork lift actuator. The user interface is preferably a set of joystick controls and a display screen serving as a control input and status indicator for the electrical control system and to the hydraulic control system.

A vehicle mount is provided for attaching the load transporter to a vehicle or trailer. The vehicle mount includes a rear enclosure, a hydraulic lift frame movably attached to the rear enclosure and a lift ramp attached to the hydraulic lift frame.

A user interface is provided that includes hardwired functions and wireless functions. A wireless remote control system is provided which enhances the ability of the load transporter to perform. For example, the user may manipulate the load transporter into a door opening without the need for a second person to hold the door open for the operator.

In the preferred embodiment, the load transporter is powered by 12 VDC AGM (absorbed glass matt) batteries or similar type of deep-cycle battery. A load cell consisting of a bank of 12 volt DC batteries mounted within the vehicle mount has the ability to provide a large volume of stored charge back to the 12 VDC AGM batteries within a connected load transporter. The vehicle mount includes an overnight, AC plug-in charging system.

These and other inventive aspects will be further described in the detailed description below.

BRIEF DESCRIPTION OF DRAWINGS

The disclosed inventions will be described with reference to the accompanying drawings.

DETAILED DESCRIPTION

Figure 1:
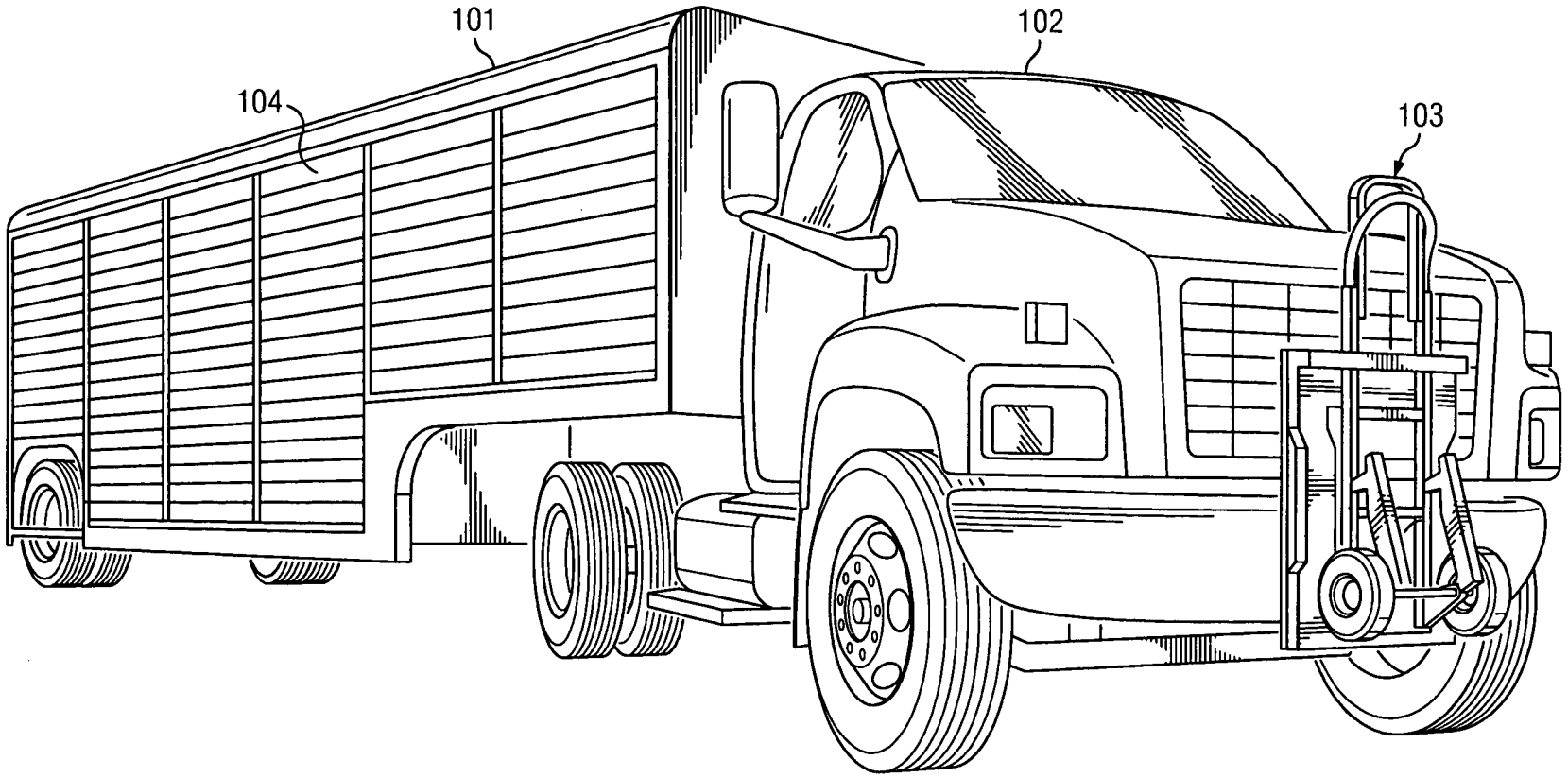
FIG. 1 is a perspective view of a prior art product tractor and trailer including a hand truck mounted to the tractor.
Figure 2A:
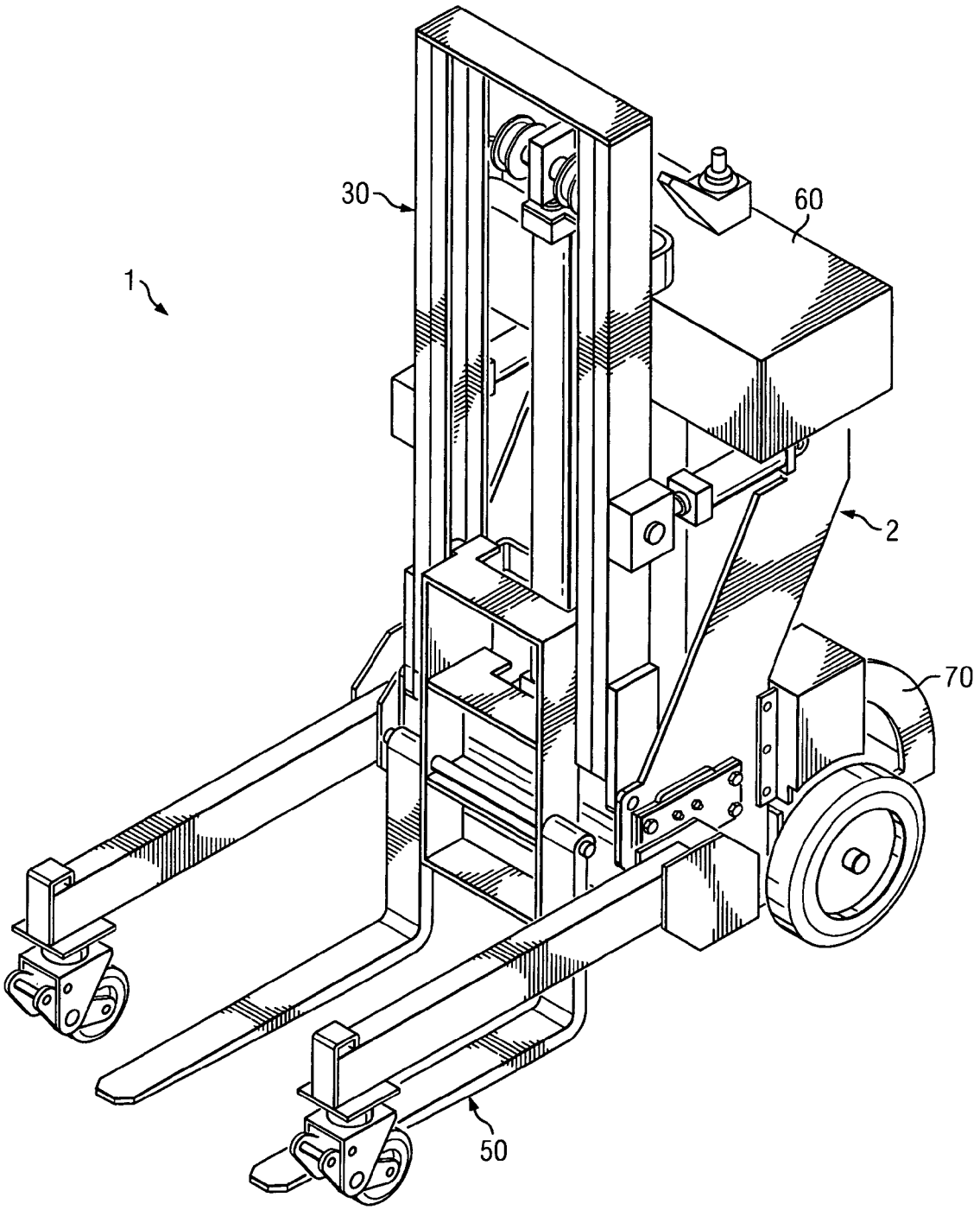
FIGS. 2A, 2B, 2C, 2D and 2E provide perspective views of a load transporter.
Figure 2B:
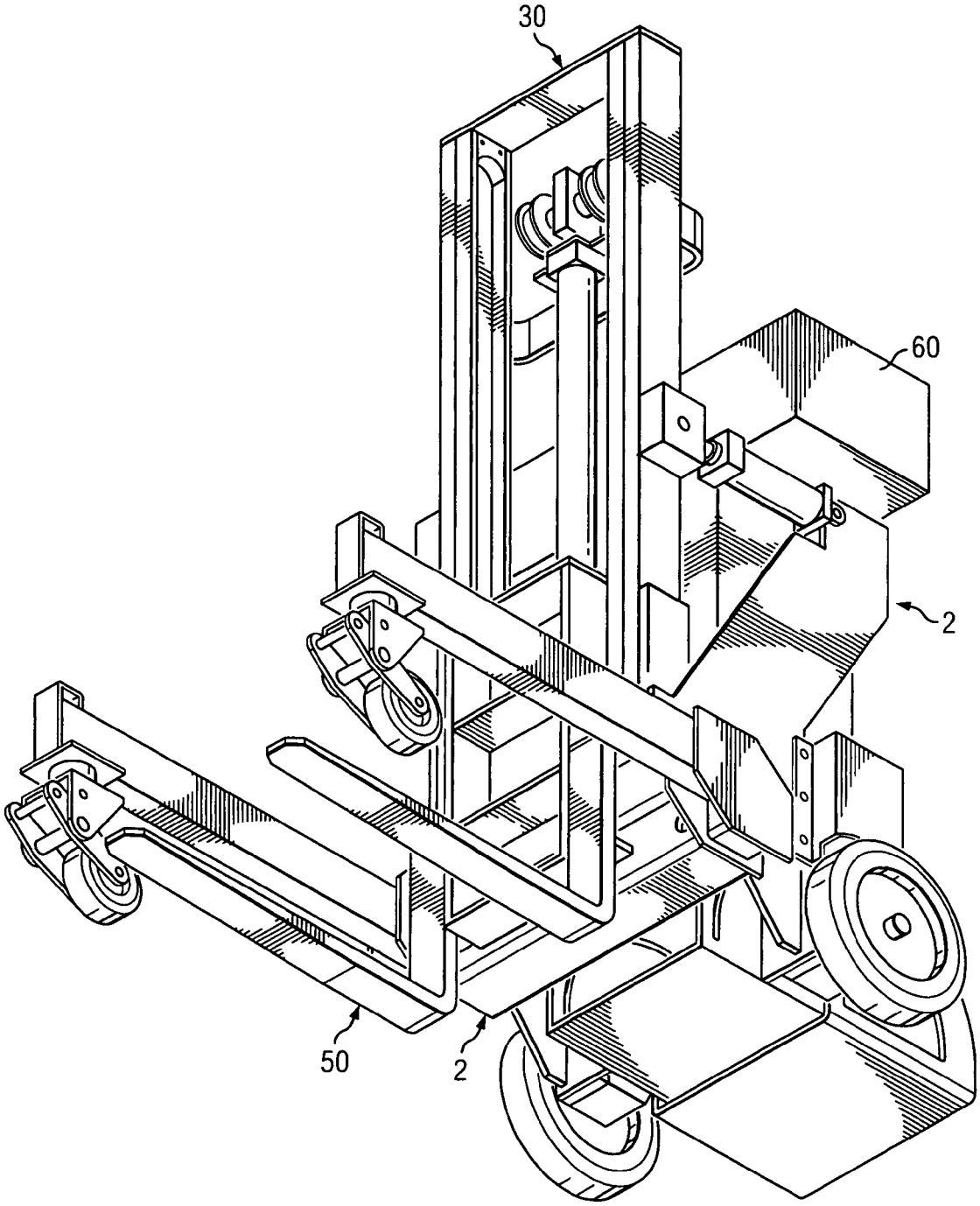
Figure 2C:
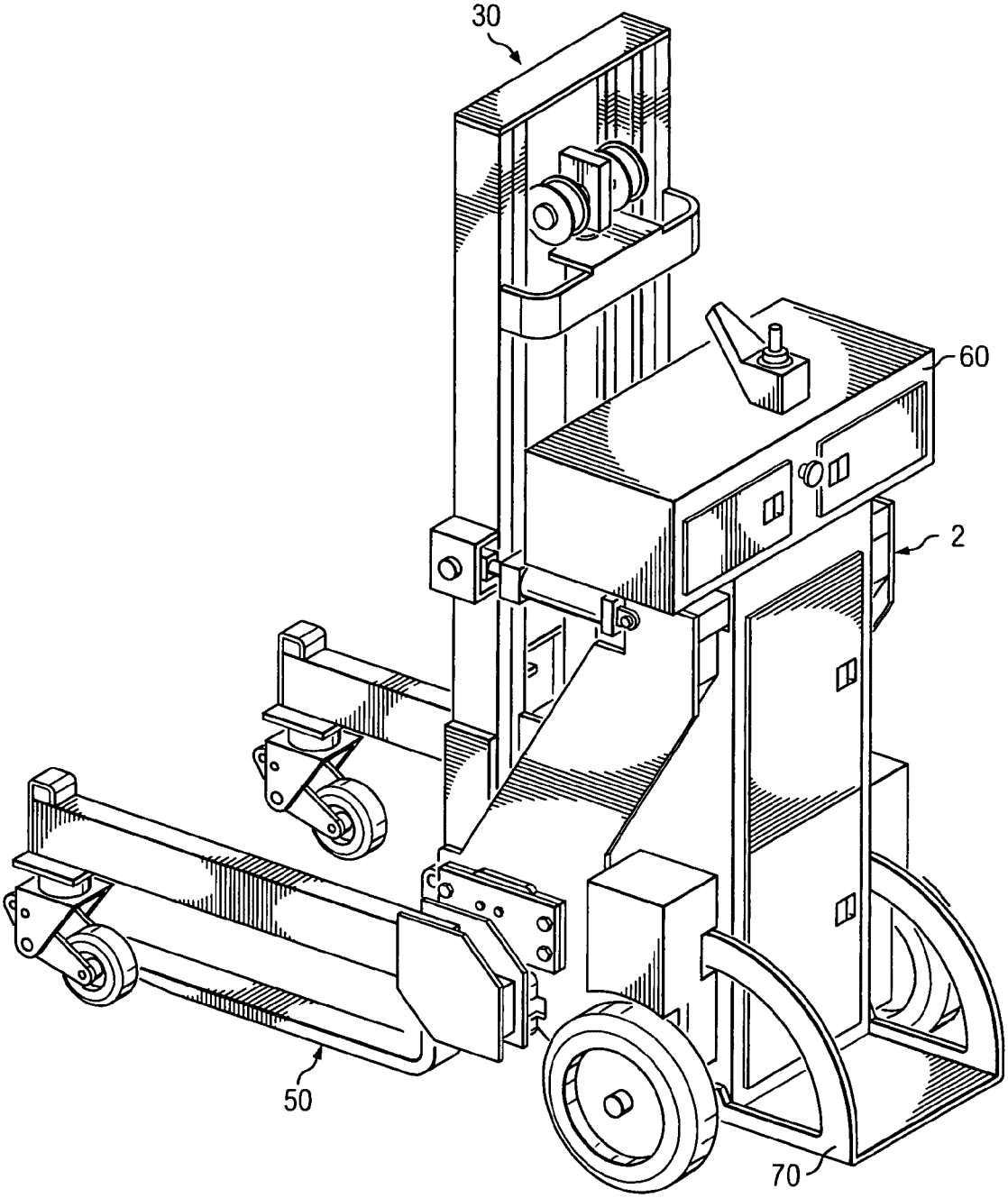
Figure 2D:
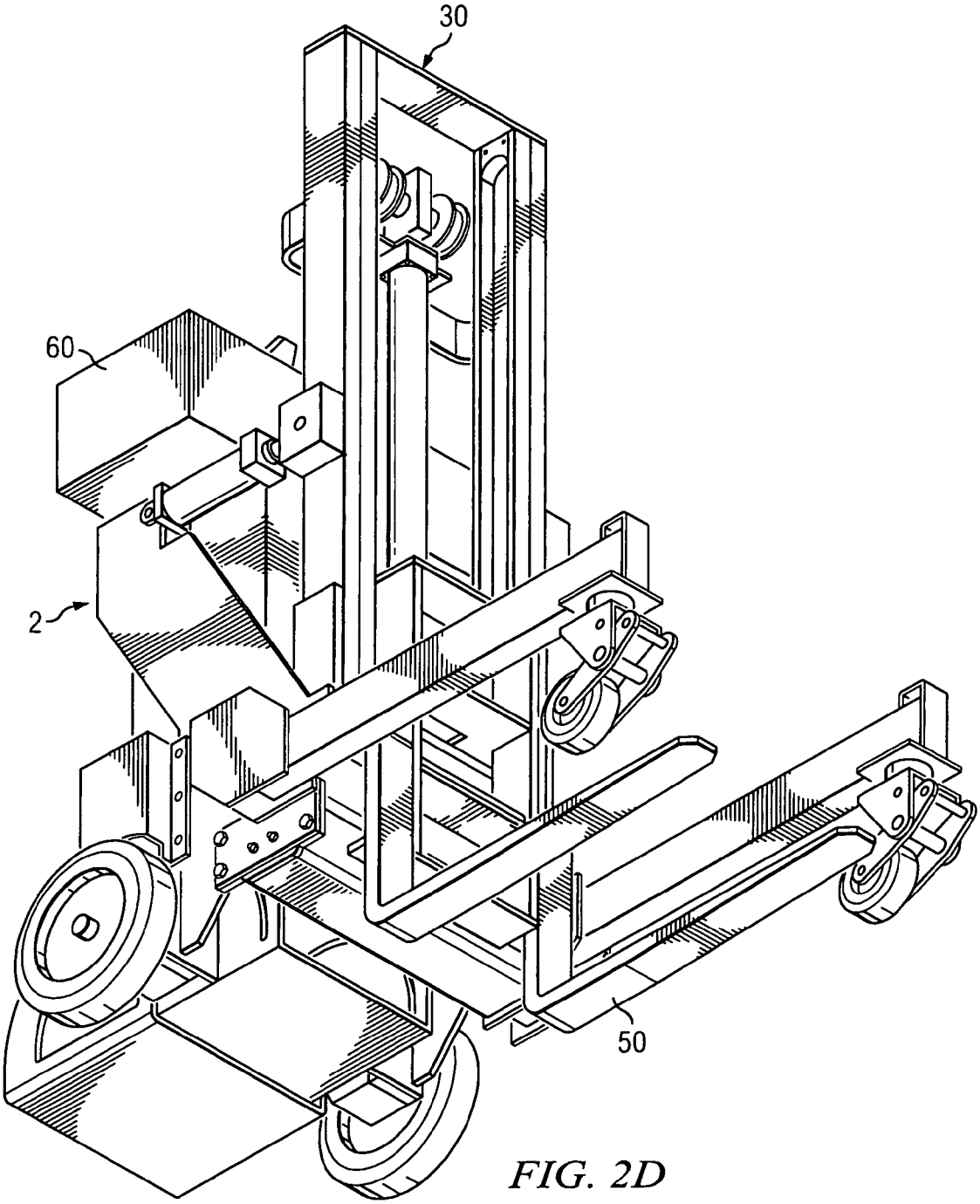
Figure 2E:
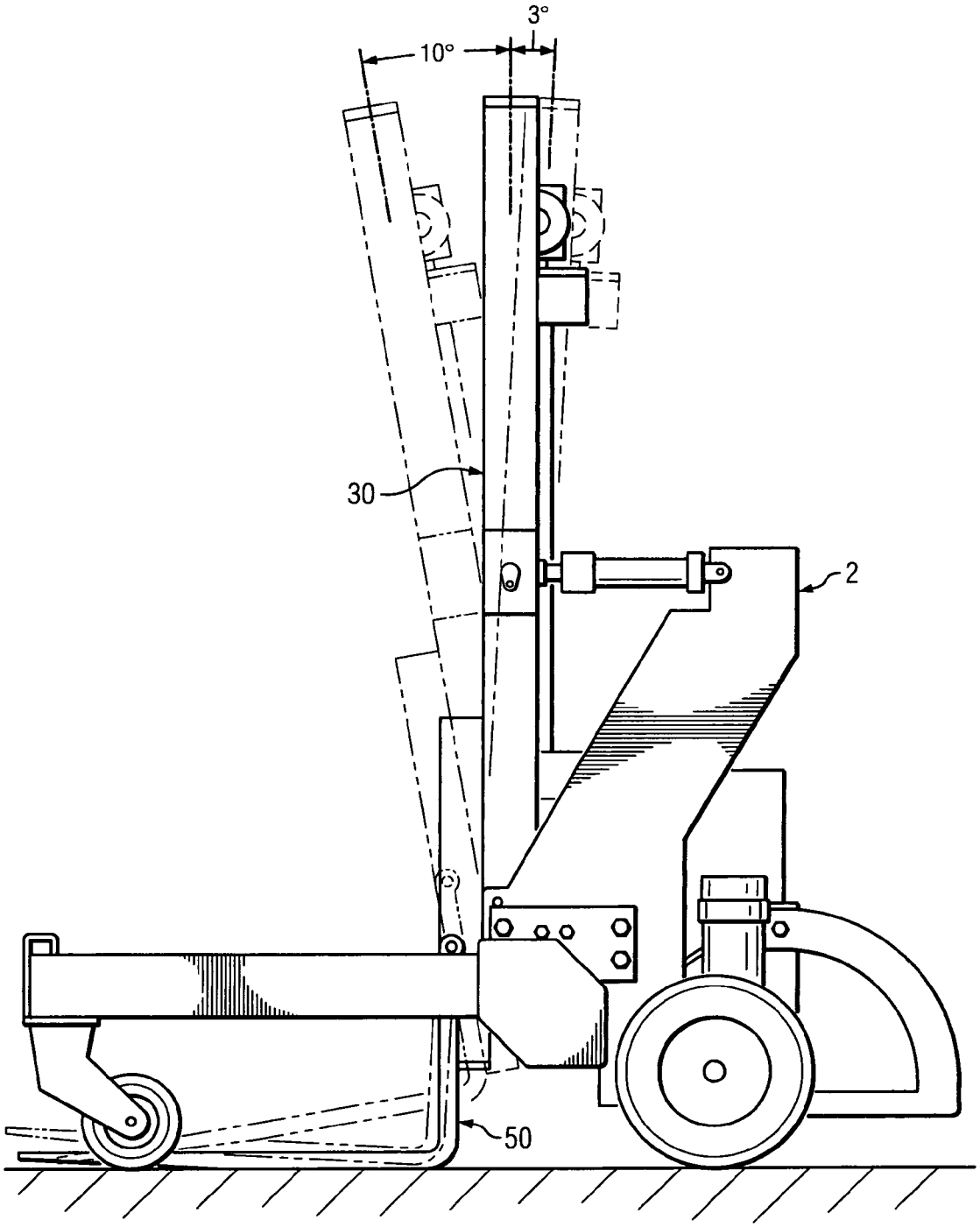

A preferred embodiment load transporter is now described beginning with the various perspectives shown in FIGS. 2A, 2B, 2C and 2D. Load transporter 1 comprises frame assembly 2, mast assembly 30, fork assembly 50 and sheet metal assembly 60. Frame assembly 2 forms the core part of the load transporter to which mast assembly 30 and sheet metal assembly 60 are attached. Fork assembly 50 is movably attached to mast assembly 30. Mast assembly 30 is rotatably attached to frame assembly 2 so that mast assembly may be rotated from vertical as shown in FIG. 2E. A rider platform 70 is rotatably attached to the back of load transporter 1 to enable a rider to operate the load transporter without risk of injury to feet and toes during transport. The dimensions of the fork assembly, the mast assembly and the frame assembly are chosen to enable a small footprint for the load transporter, further enabling access to narrow throughways and small areas to pick up and transport loads into areas that traditionally require humans to physically lift and carry loads.

Figure 3A:
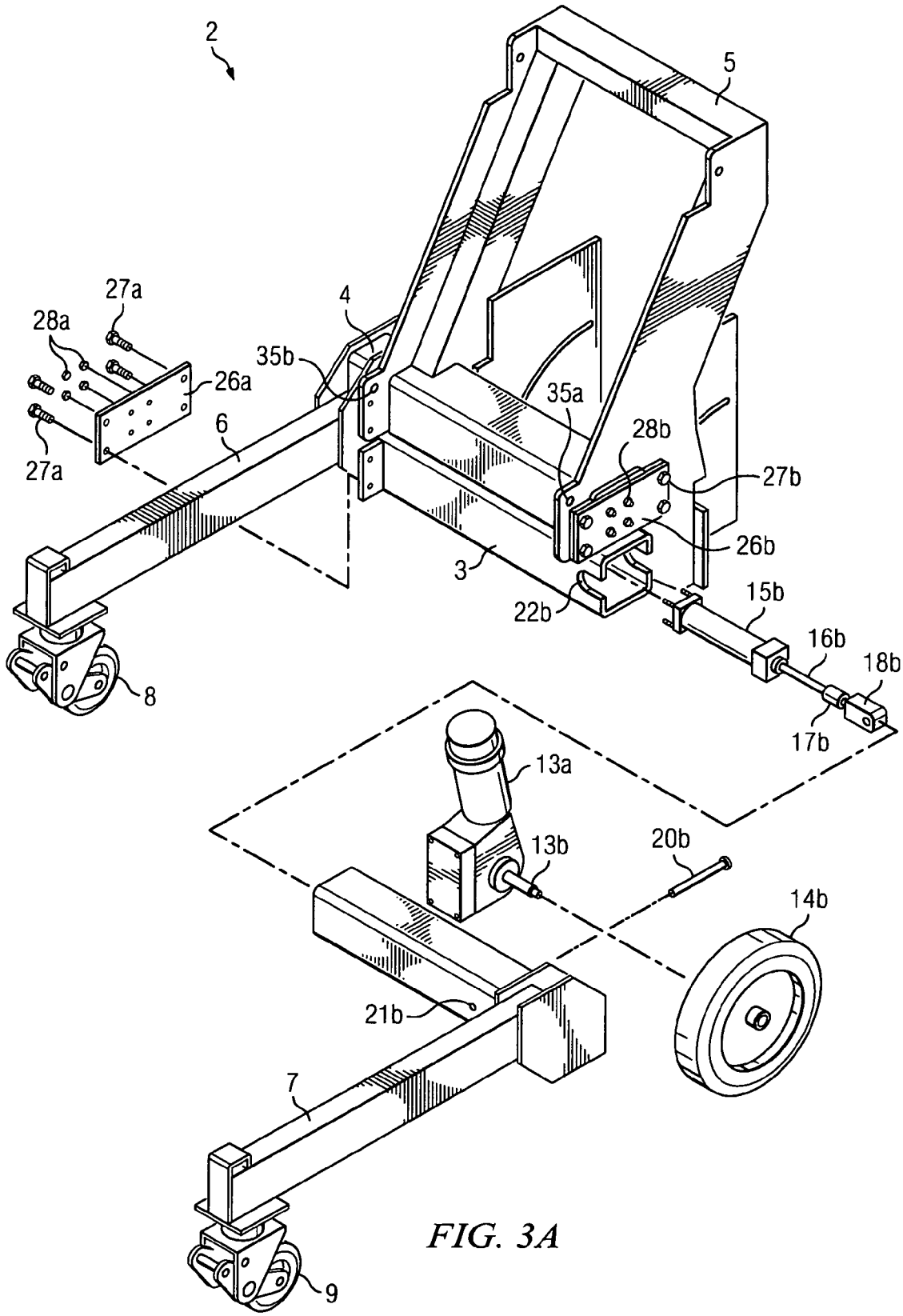
FIGS. 3A, 3B and 3C are exploded views of the frame assembly and frame assembly components of a load transporter.
Figure 3B:
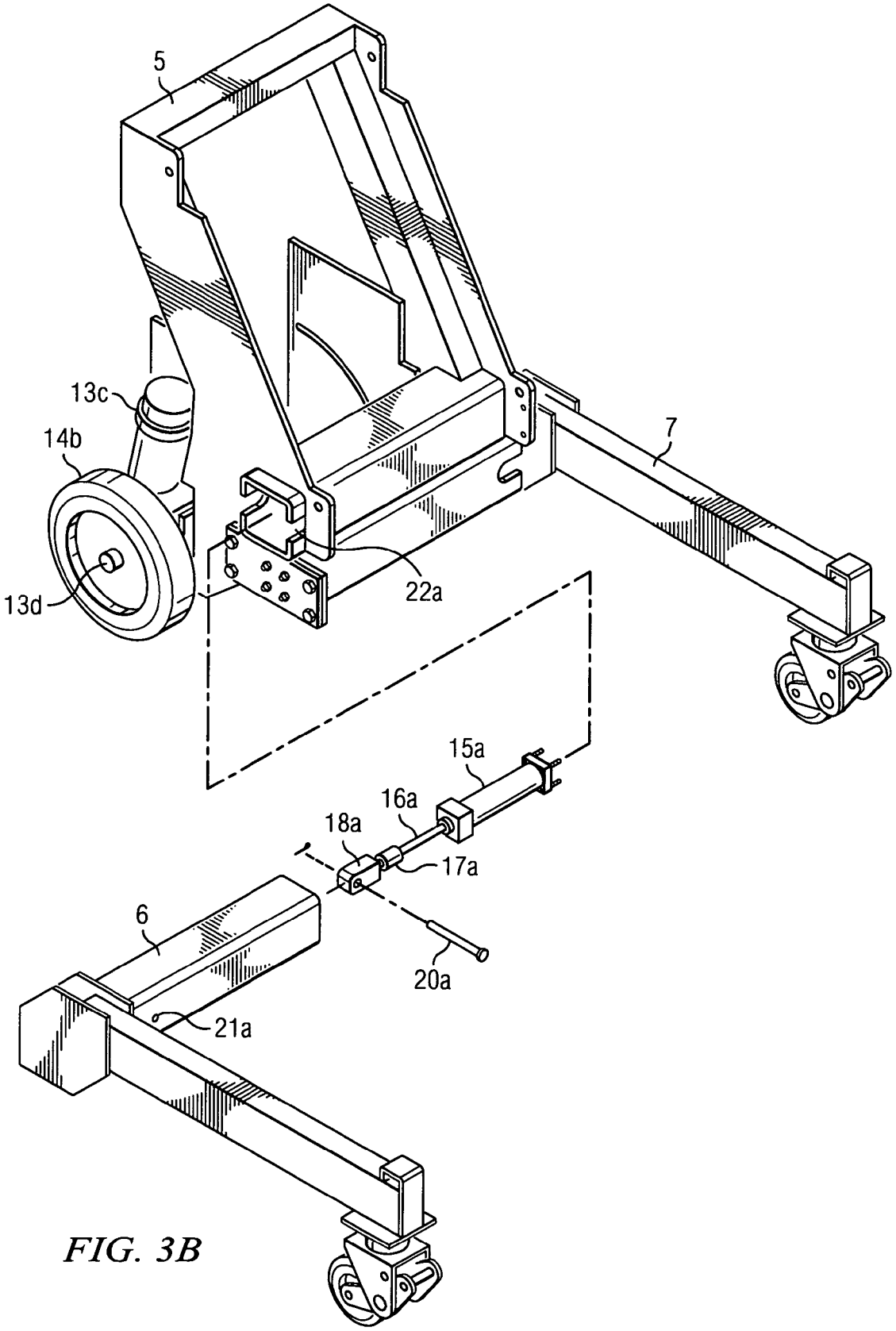
Figure 3C:
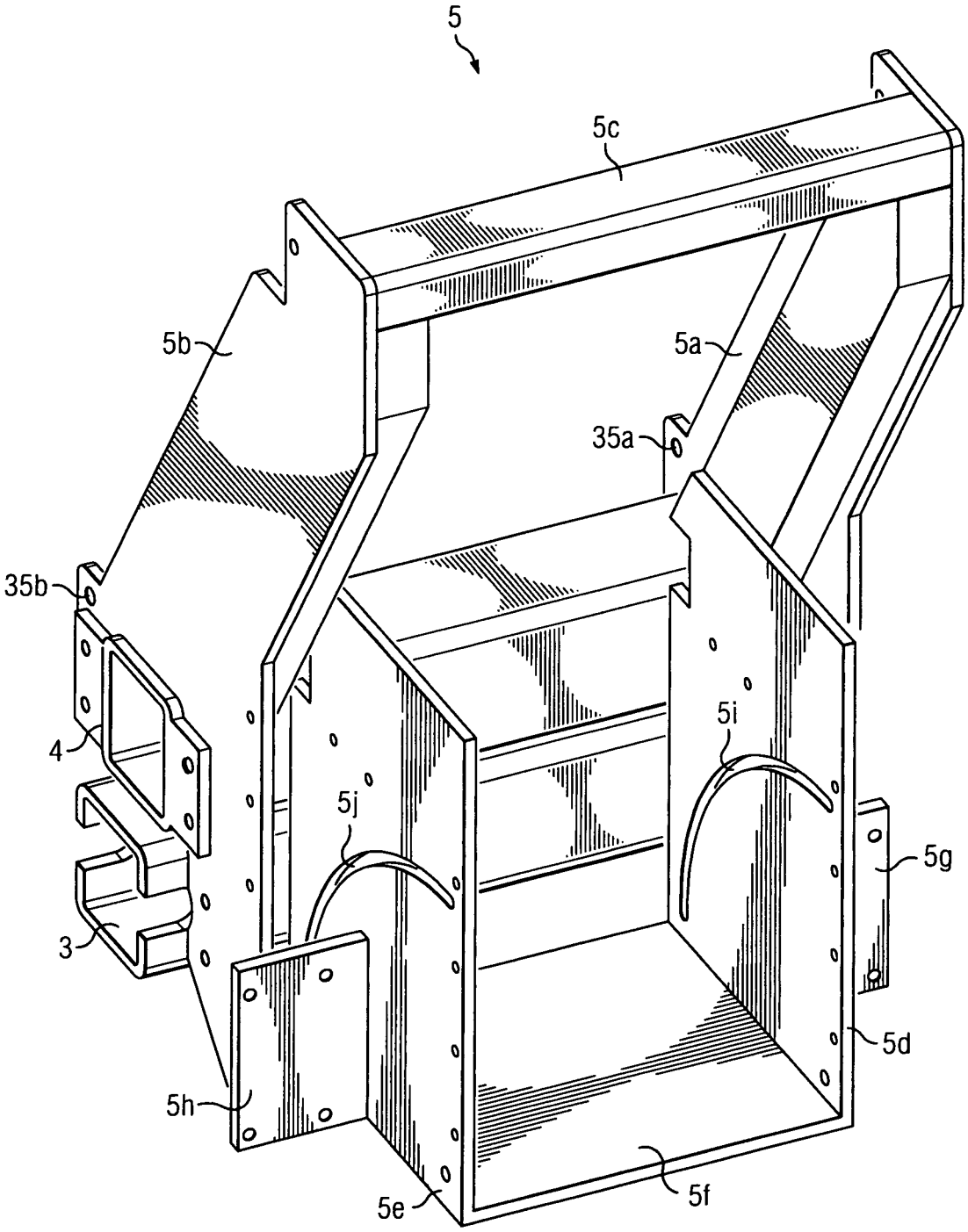

FIGS. 3A, 3B and 3C show the frame assembly and frame with their components and features. Frame assembly 2 comprises frame 5, right front arm 6 and left front arm 7. The frame assembly components are preferably made of steel and attached by welding or by bolts and nuts as required for manufacturing and ease of assembly.

Frame 5 has right frame plate 5*a* and left frame plate 5*b* attached by cross member 5*c*. To the right frame plate is attached right side plate 5*d* and right motor flange 5*g*. To the left frame plate is attached left side plate 5*e* and left motor flange 5*h*. Right side plate 5*d* is attached to left side plate 5*e* by bottom plate 5*f*. The right and left side plates include right and left curved slots 5*i* and 5*j*, respectively. Left channel 3 and right channel 4 are attached to the left and right frame plates and to the left and right side plates to complete the frame. Two pivot holes, left pivot hole 35*b* and right pivot hole 35*a* are drilled through frame 5 from the left and right sides, respectively.

Right front arm 6 slides into right channel 4 and left front arm 7 slides into left channel 3. Right front wheel assembly 8 is attached to right front arm 6 and left front wheel assembly 9 is attached to left front arm 7. Left wheel motor 13*a* with left axle 13*b* is attached to left motor flange 5*h* and left rear wheel 14*a* is attached to the left axle. Similarly, right wheel motor 13*c* with right axle 13*d* is attached to right motor flange 5*g*. A right rear wheel 14*b* is attached to right axle 13*d*.

Left arm actuator 15*b* is attached to right actuator plate 26*a* by set of hex nuts 28*a*. Right actuator plate 26*a* is attached to frame 5 on right side of left channel 3 by set of bolts 27*a*. Left arm actuator 15*b* comprises left extender rod 16*b* and left eye 18*b* attached to the left extender rod by left alignment coupler 17*b*. Left front arm 7 includes left hole 21*b* for attaching the left actuator and thereby the frame to the left front arm. Left eye 18*b* is attached to left front arm 7 by means of a left actuator pin 20*b* inserted through left hole 21*b* and through left eye 18*b*. Slot 22*b* is cut into frame 5 to allow for the left actuator pin and left front arm to slide as far as possible into left channel 3.

Right arm actuator 15*a* is attached to left actuator plate 26*b* by set of hex nuts 28*b*. Left actuator plate 26*b* is attached to frame 5 on left side of right channel 4 by set of bolts 27*b*. Right arm actuator 15*a* comprises right extender rod 16*a* and right eye 18*a* attached to the right extender rod by right alignment coupler 17*a*. Right front arm 6 includes right hole 21*a* for attaching the right actuator and thereby the frame to the right front arm. Right eye 18*a* is attached to right front arm 6 by means of a right actuator pin 20*a* inserted through right hole 21*a* and through right eye 18*a*. Slot 22*a* is cut into frame 5 to allow for the right actuator pin and right front arm to slide as far as possible into right channel 4.

Figure 4A:
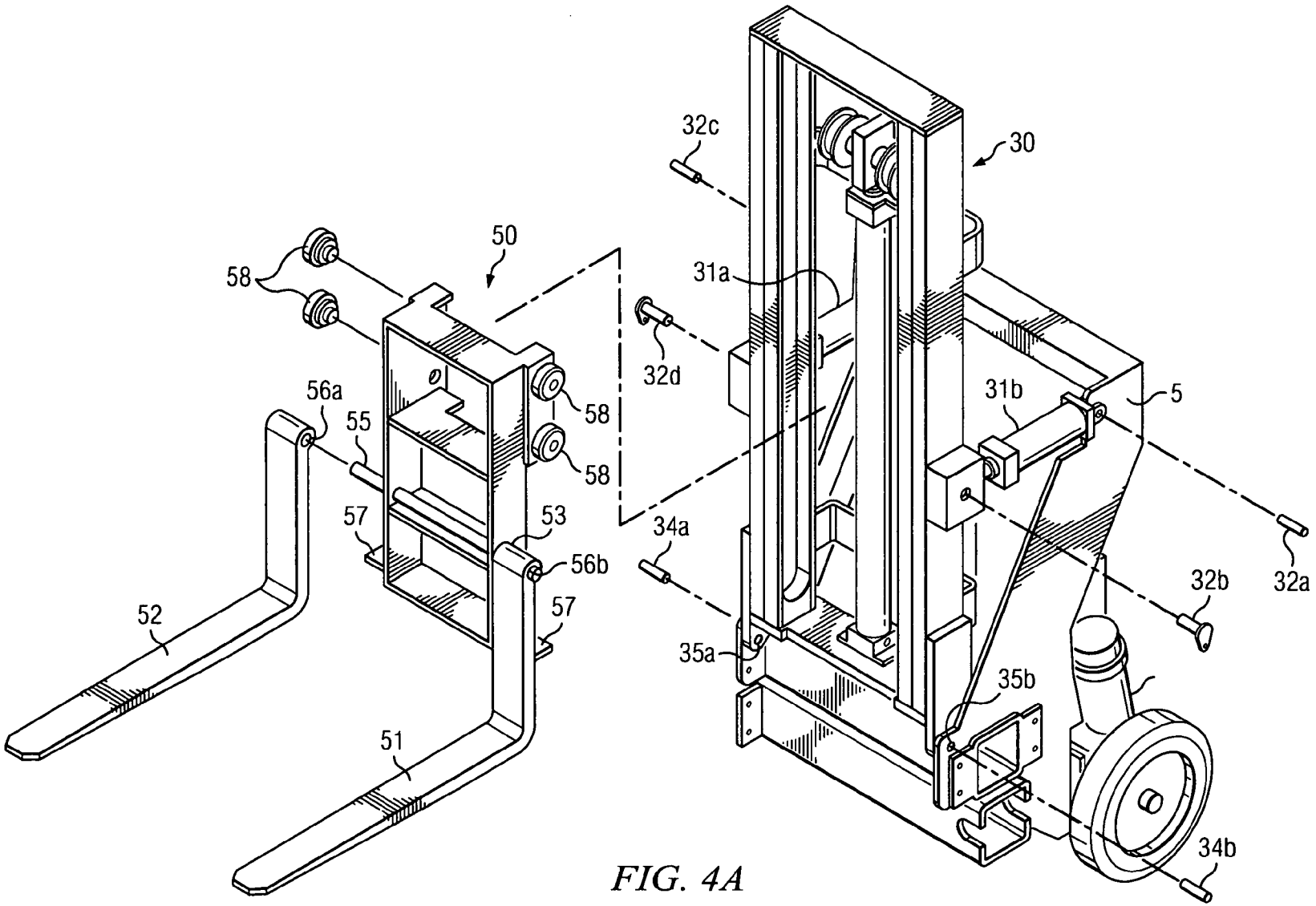
FIGS. 4A and 4B are exploded views of the frame assembly, mast assembly, fork assembly and related components of a load transporter.
Figure 4B:
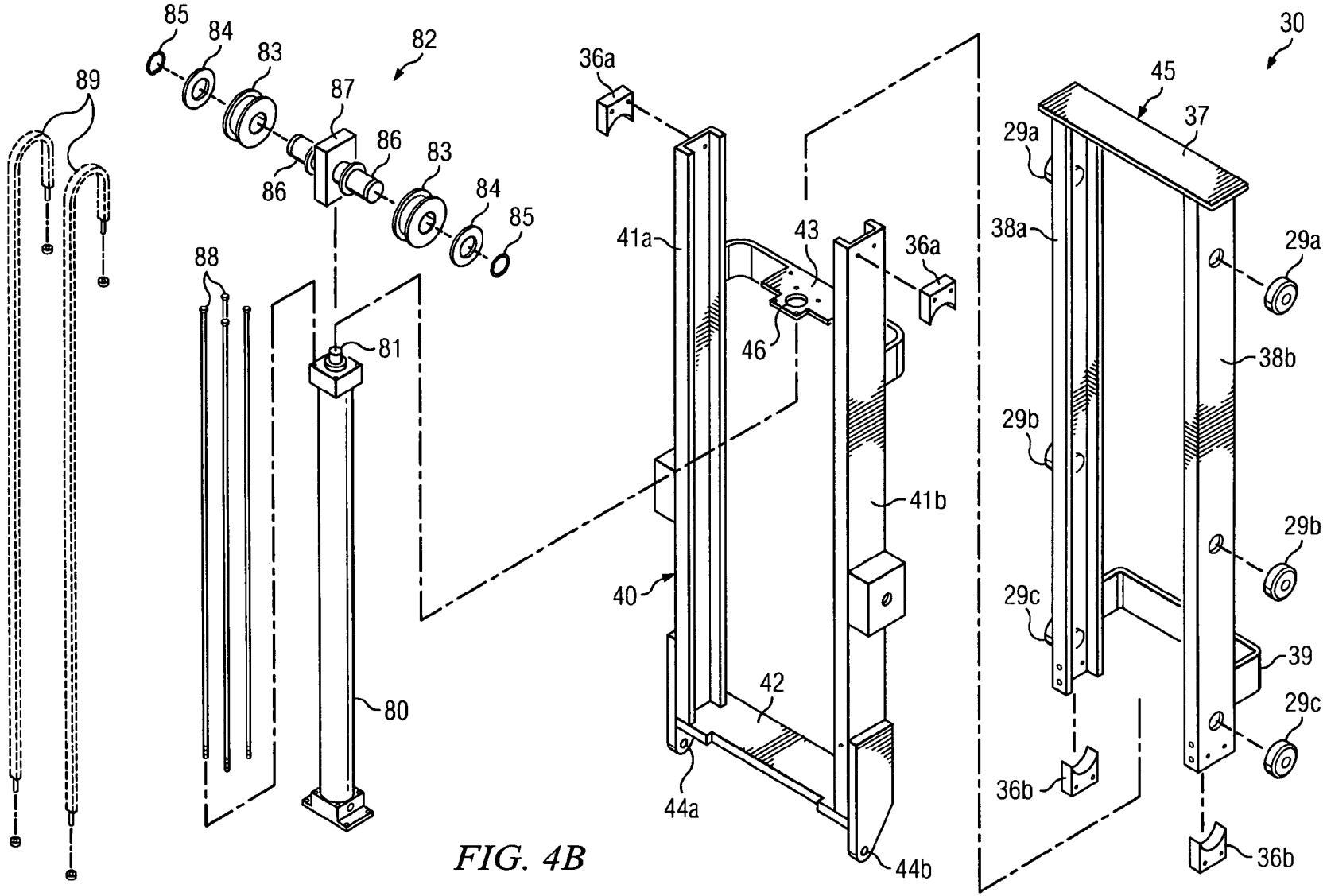

FIGS. 4A and 4B show the mast and fork assemblies of the preferred embodiment and their attachment to the frame assembly. Mast assembly 30 is rotatably attached to frame 5. Left hinge pin 34*b* is inserted through left hole 44*b* in the mast assembly, then into left pivot hole 35*b* of the frame assembly, and held in place by a conventional fastener. Similarly, right hinge pin 34*a* is inserted through right hole 44*a* in the mast assembly, then into the right pivot hole 35*a* of the frame assembly and held in place by a conventional fastener. Left mast actuator 31*b* is attached to frame 5 with left rear pin 32*a* and further attached to mast assembly 30 with left front pin 32*b*. Right mast actuator 31*a* is attached to frame 5 with right rear pin 32*c* and further attached to mast assembly 30 with right front pin 32*d*.

As shown in FIG. 4A, fork assembly 50 utilizes a set of roller bearings inserted into channels of the mast assembly so that it may be moved up and down along with the mast assembly. A set of fork roller bearings 58 are rotatably attached to the sides of fork frame 53. Two roller bearings per side at each of a set of upper and lower positions are preferred. Set of fork roller bearings 58 ride inside the left and right telescoping channels. Fork pin 55 is fixed to fork frame 53. Left fork 51 and right fork 52 are rotatably fastened onto fork pin 55 via fork eye holes 56*a* and 56*b*. Left fork 51 and right fork 52 pivot on fork pin 55 so that the arms of the left and right forks rest on fork stop 57 of the fork frame.

Referring to FIG. 4B, mast assembly 30 comprises upper mast frame 45 movably attached to lower mast frame 40. The linear movement of upper mast frame 45 and the fork assembly is controlled by a fork actuator assembly.

Lower mast frame 40 comprises right mast channel 41*a*, left mast channel 41*b*, lower plate 42 connecting the right mast channel to the left mast channel near the lower end and a fork actuator mount 43 connecting the right mast channel to the left mast channel near the upper end of the mast channels. Left hole 44*b* and right hole 44*a* are positioned in lower plate 42, near the right and left mast channels, respectively. Pair of upper stops 36*a* are attached to the right and left mast channels near the top of the lower mast frame.

Fork actuator 80 is attached to lower mast frame 40 at lower plate 42 and at fork actuator mount 43 by fork actuator mounting bolts 88. Fork actuator 80 includes movable fork actuator rod 81 to which chain pulley assembly 82 is attached. Chain pulley assembly 82 comprises actuator stop 87 having pulley rod 86 inserted through to which pair of pulleys 83 are rotatably mounted and held in place by pair of washers 84 and pair of snap connectors 85. Fork actuator 80 is attached to the lower mast frame so that movable fork actuator rod 81 is inserted through hole 46 in fork actuator mount 43 so that the fork actuator rod may freely move in the vertical direction for a length approximately equal to the length of fork actuator 80.

Pair of chains 89 traverse pair of pulleys 83. One end of each chain is attached to fork actuator mount 43 and the other end of each chain attached to the fork assembly.

Upper mast frame 45 comprises left telescoping channel 38*b*, right telescoping channel 38*a*, cross-member 39 connecting the right telescoping channel to the left telescoping channel near the lower end, and top plate 37 connecting the right telescoping channel to the left telescoping channel at the top end. Set of mast roller bearings 29*a-c* are attached to the left and right telescoping channels in pairs. Upper pair 29*a* is positioned near the top of the channels. Pair 29*b* is centrally attached. Pair 29*c* is attached near the bottom. Pair of lower stops 36*b* are attached to the right and left telescoping channels near the bottom of the upper mast frame.

Upper mast frame 45 is positioned in lower mast frame 40 adjacent to the set of mast roller bearings and mast channels, 41*a* and 41*b*, in such a way that the upper mast frame is constrained to translate linearly with respect to the lower mast frame.

Figure 8C:
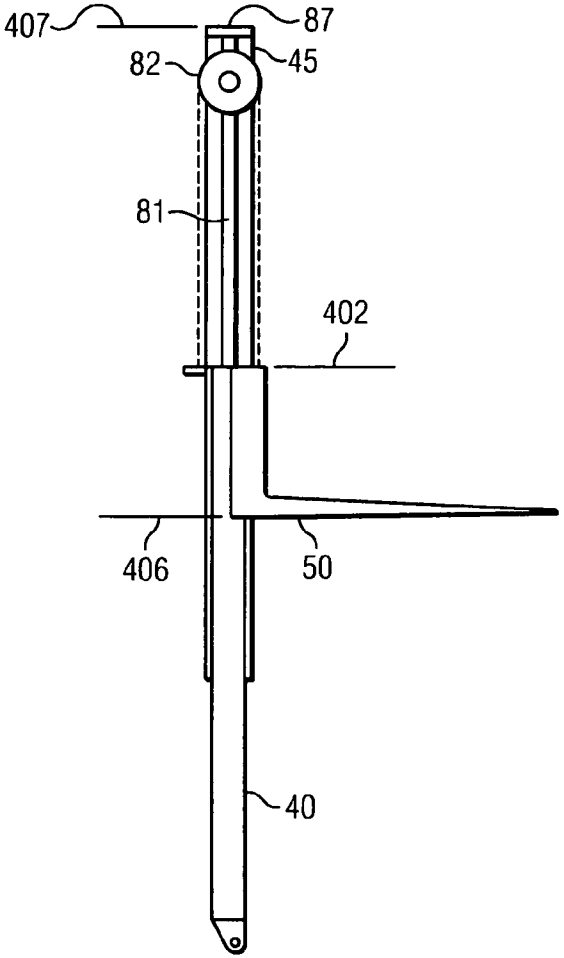
FIGS. 8A, 8B and 8C provide a side view of three positions of the fork assembly as actuated within the mast assembly.
Figure 8B:
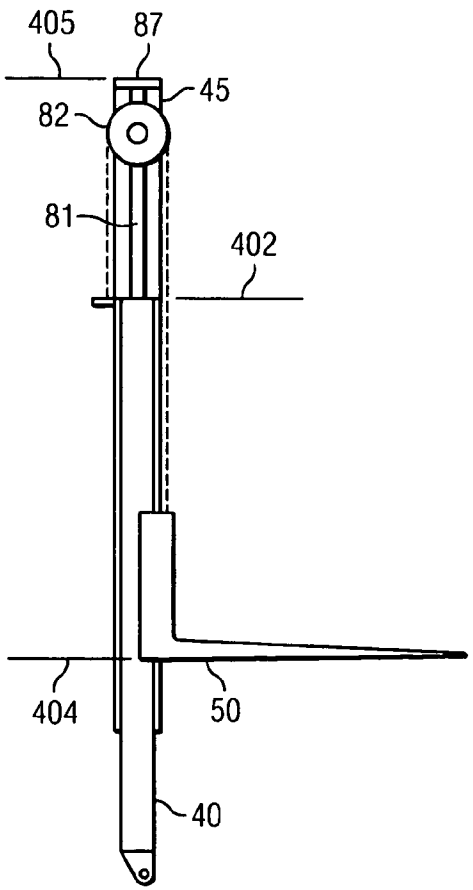
Figure 8A:
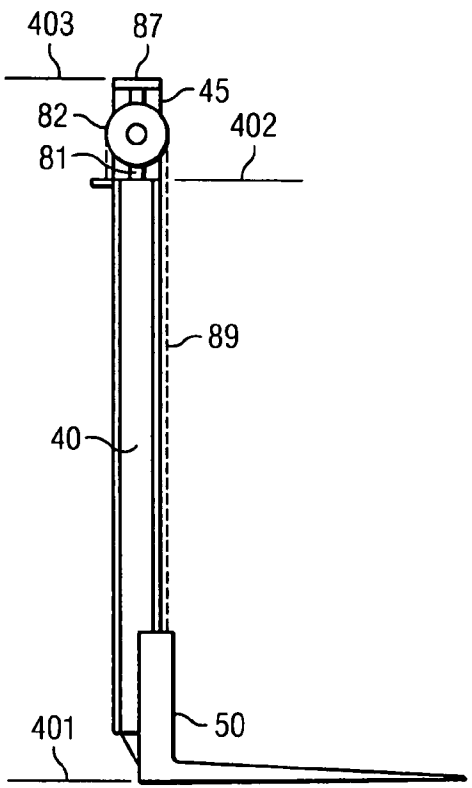

As shown in FIG. 8A, fork assembly 50 is in position 401 with the forks at or near ground level 400 and well below the top of lower mast frame 40 at position 402. Fork actuator rod 81 is in a low position. Upper mast frame 45 is in position 403. Actuator stop 87 is in contact with the top plate of upper mast frame 45.

As shown in FIG. 8B, fork actuator rod 81 is actuated to a medium length which in turn places fork assembly 50 at position 404, a medium height above ground level 400. Upper mast frame 45 is also in a medium position 405 with respect to position 402 on the lower mast frame; position 402 is stationary with respect to ground level 400.

As shown in FIG. 8C, fork actuator rod 81 is actuated to full length which in turn places fork assembly 50 at position 406. Upper mast frame 45 is fully extended to position 407 with respect to position 402 on the lower mast frame; position 402 remains stationary with respect to ground level 400.

In FIGS. 8A-8C, pair of chains 89 are fixed in length and form a 2:1 pulley system, along with chain pulley assembly 82 including actuator stop 87, whereby when the fork actuator is raised a distance X, the fork assembly is raised a distance 2X.

Figure 5:
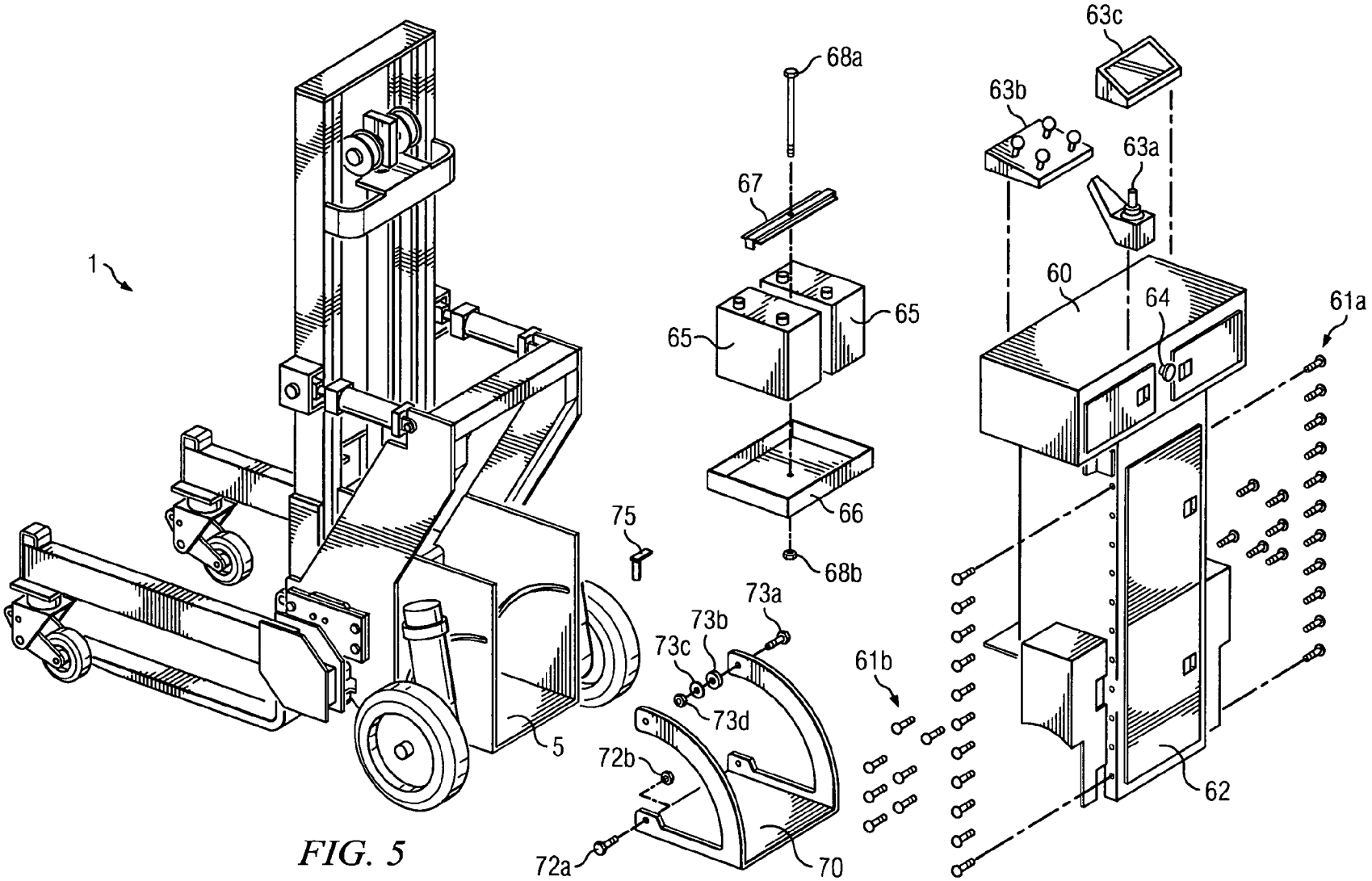
FIG. 5 is an exploded view of the sheet metal assembly and various components.

As shown in FIG. 5, sheet metal assembly 60 attaches to the right side of frame 5 near the right side plate and the cross member with a set of right sheet metal screws 61*a*, and, attaches to the left side of frame 5 near the left side plate with set of left sheet metal screws 61*b*. Sheet metal assembly 60 includes a set of doors 62 for accessing the inner components of the load transporter and for storage. Stop button 64, joystick 63*a*, a hydraulic control panel 63*b* and display 63*c* are attached to sheet metal assembly 60.

Rider platform 70, is rotatably attached to frame 5 with pair of threaded pins 72*a* and accompanying nuts 72*b*, one threaded pin and one nut on either side of the frame. Rider platform 70 is further attached to frame 5 with a pair of threaded slide pins 73*a* in combination with pair of slide spacers 73*b*, pair of slide washers 73*c* and pair of slide nuts 73*d*. Rider platform 70 is latched into a closed position with step latch 75 which is attached to frame 5. Rider platform 70 is released by step latch 75 into a down position.

Internal components include a motor controller unit, a hydraulic manifold, and a set of batteries. Battery pan 66, which holds batteries 65, is attached to frame 5. The batteries are held in place with battery holder 67, battery bolt 68*a*, pan 66 and nut 68*b*. A motor controller unit, a hydraulic manifold, and a hydraulic pump system are also attached to frame 5.

Figure 6:
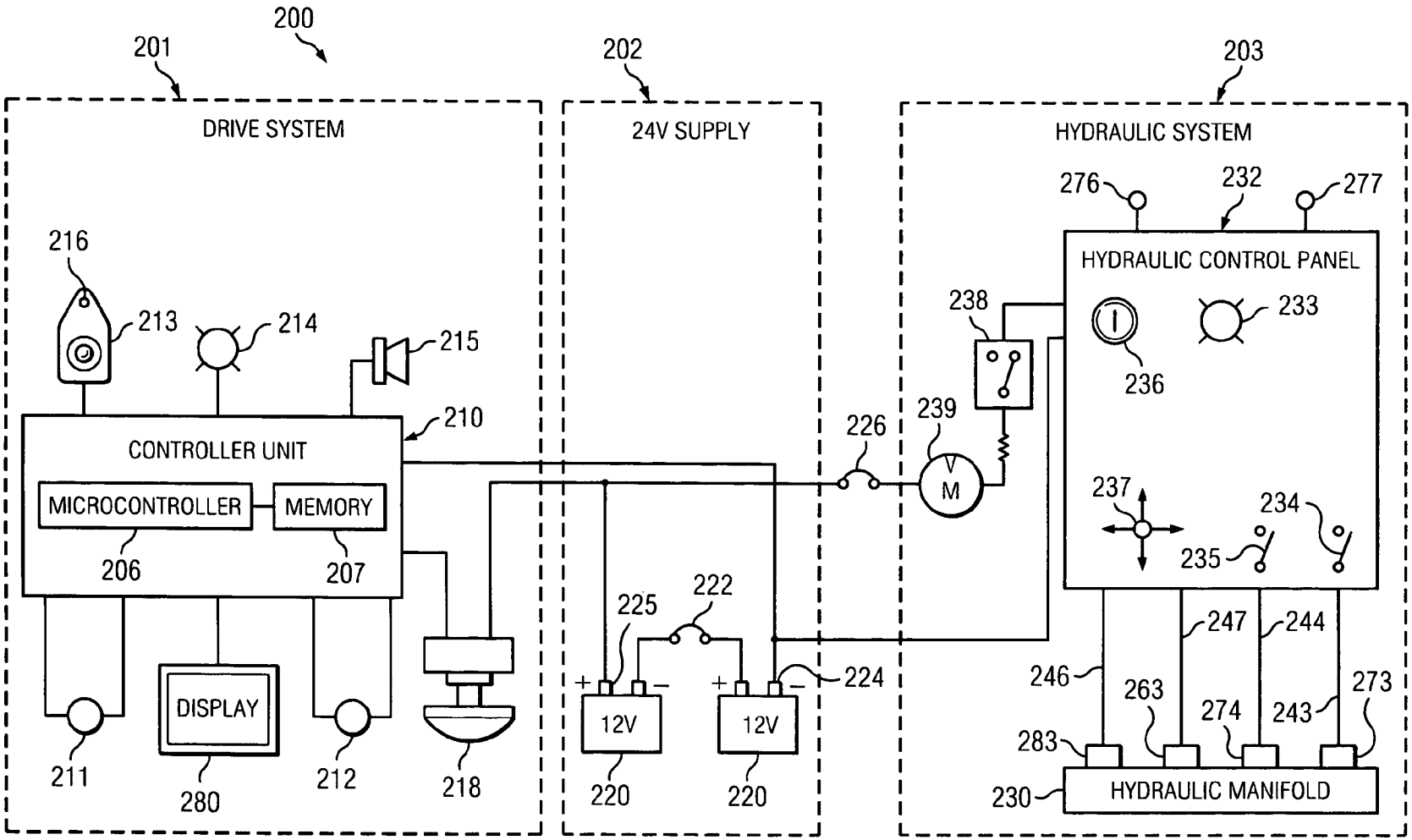
FIG. 6 is a circuit diagram showing the control circuit for the load transporter.

Referring to FIG. 6, control circuit 200 of the load transporter includes a motor control circuit 201, power circuit 202 and hydraulic control circuit 203. Pair of 12V batteries 220 are connected in series to form a 24V power source. First circuit breaker 222 connects the negative terminal of a first battery to the positive terminal of a second battery. Positive supply terminal 225 and negative supply terminal 224 are available for connection to the other components.

Motor control circuit 201 comprises controller unit 210 suitable to control left drive motor 211 and right drive motor 212. Motor joystick control 213 incorporating power switch 216 is electrically connected to the controller unit, as are strobe light 214 and audible alarm 215 for indicating that the load transporter is moving in reverse. Display 280 is also connected to the controller unit. Emergency stop button 218 is connected between controller unit 210 and positive supply terminal 225 in such a way that the connection between controller unit 210 and power circuit 202 is broken when the emergency stop button is depressed.

Controller unit 210 further comprises a microcontroller 206 connected to on-board memory 207 for storing programmed movements of the load transporter.

Batteries 220 are preferably 12 VDC AGM (absorbed glass matt) batteries of 135 Ah capacity or similar type of deep-cycle battery. Also, AGM type batteries charge approximately five times faster than a traditional lead-acid battery, and have a much lower self-discharge rate than lead-acid batteries allowing for better charge recovery when not in use.

Hydraulic control circuit 203 comprises hydraulic manifold 230 and hydraulic control panel 232.

Hydraulic control panel 232 comprises keyed power switch 236 and power indicator light 233 along with right outrigger control 234, left outrigger control 235, and hydraulic joystick control 237 for fork actuation (lift) and mast actuation (tilt). The hydraulic joystick control is electrically connected to the hydraulic manifold to control hydraulic fluid pressure to the fork actuator. The hydraulic joystick control is further electrically connected to the hydraulic manifold to control hydraulic fluid pressure to the left and right mast actuators. The left and right outrigger controls are electrically connected to the hydraulic manifold to control hydraulic fluid pressure to the left and right arm actuators.

Hydraulic control panel 232 includes power connections to positive supply terminal 225 and negative supply terminal 224, the positive supply terminal preferably connected by second circuit breaker 226. Hydraulic control circuit 203 includes pressure switch 238 and ammeter 239 placed in line with the power connections.

Hydraulic control circuit 203 controls four hydraulic control lines associated with four hydraulic directional control valves. Hydraulic control line 247 is an electrical connection between hydraulic control circuit 203 and directional valve 263. Hydraulic control line 243 is an electrical connection between hydraulic control circuit 203 and directional valve 273. Hydraulic control line 244 is an electrical connection between hydraulic control circuit 203 and directional valve 274. Hydraulic control line 246 is an electrical connection between hydraulic control circuit 203 and directional valve 283.

The hydraulic control circuit is further connected to an upper micro-switch 276 placed at the upper limit of travel on the set of upper stops and a lower micro-switch 277 placed on the lower stops at the lower limit of travel with a corresponding hydraulic circuit included to disable further hydraulic flow when either the upper or lower micro-switches are activated.

Figure 7:
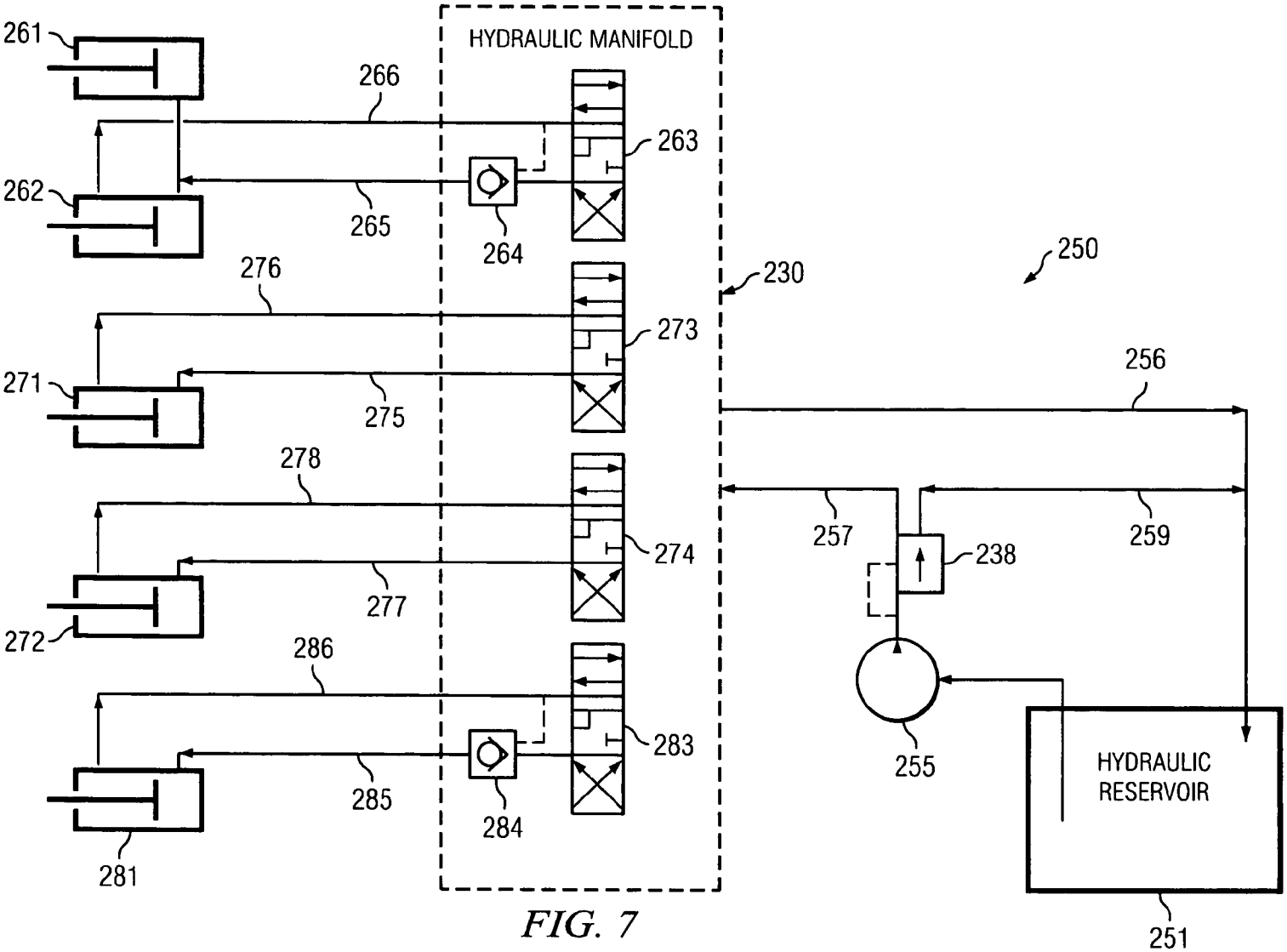
FIG. 7 is a hydraulic circuit diagram of the hydraulic system of the load transporter.

Referring to FIG. 7, hydraulic system 250 is a closed system containing a hydraulic fluid supplied from hydraulic reservoir 251 and pressurized by hydraulic pump 255. Hydraulic pump 255 is attached to hydraulic reservoir 251 and to hydraulic supply lines 257. Pressure switch 238 is also attached to hydraulic supply lines 257 and to hydraulic reservoir 251 via pump bypass line 259 to allow for system pressure regulation. Hydraulic return lines 256 and hydraulic supply lines 257 are further attached to hydraulic manifold 230. The set of actuators include right mast actuator 261 and left mast actuator 262 for tilting the mast assembly, right arm actuator 271 and left arm actuator 272 for expanding the front right and front left arms as an outrigger for the load transporter, and fork actuator 281 for raising and lowering the fork assembly.

Hydraulic manifold 230 includes a set of directional valves comprising directional valve 263, directional valve 273, directional valve 274, and directional valve 283. The set of directional valves are each connected to hydraulic supply line 257 and hydraulic return line 256 and to a first and a second pressurizing chamber of each of the set of actuators. The set of directional valves are electrically connected to and controllable by the hydraulic control circuit to control fluid pressure to the pressurizing chambers of the set of actuators.

The set of directional valves are preferably 4-port 3-state directional control valves comprising an "a" and a "b" solenoid. A suitable part for each directional valve is the Argo-Hytos part number RPE3-063Y11/02400E1. Where a check valve is used, the check valve is of a pilot-to-open type. A suitable part for the check valve is model CKCB from Sun Hydraulics. A suitable part for the pump and reservoir system is the 3 KW DC HPU from Hydra-Lube of St. Charles, La. Suitable hydraulic actuators are HLLH25250B for the fork actuator, HLLH3200B for the tilt actuator, and HLP0200/0 for the front arm actuators also from Hydra-Lube.

For reference, directional valve positional states for the hydraulic system are: state "0" which connects both chambers of a hydraulic actuator to the return side of the hydraulic system and is activated by powering neither of the "a" and "b" solenoids; state "a" which connects a first chamber of the hydraulic actuator to the supply side and the second chamber of the hydraulic actuator to the return side thereby pressurizing the first chamber, and is activated by powering the "a" solenoid alone; state "b" which connects the second chamber of the hydraulic actuator to the supply side and the first chamber to the return side thereby pressurizing the second chamber, and is activated by powering the "b" solenoid alone.

The hydraulic lines of the left and right mast actuators hydraulic lines are connected together and to directional valve 263 by supply line 265. Check valve 264 is further inserted into supply line 265 to hold pressure against a load experienced by the left and right mast actuators. Return line 266 is connected between the left mast actuator and directional valve 263 and also to the pilot port of check valve 264. Directional valve 263 is controlled by the hydraulic joystick control.

The right arm actuator is connected to directional valve 273 by supply line 275 and return line 276. The left arm actuator is connected to the directional valve 274 by supply line 277 and return line 278. Directional valves 273 and 274 are controlled by the left and right outrigger controls.

The fork actuator is connected to directional valve 283 by supply line 285. Check valve 284 is further inserted into supply line 285 to hold pressure against a load on the fork actuator. Return line 286 is connected between the fork actuator and the directional valve 283 and also to the pilot port of check valve 284. Directional valve 283 is controlled by the hydraulic joystick control.

Figure 10:
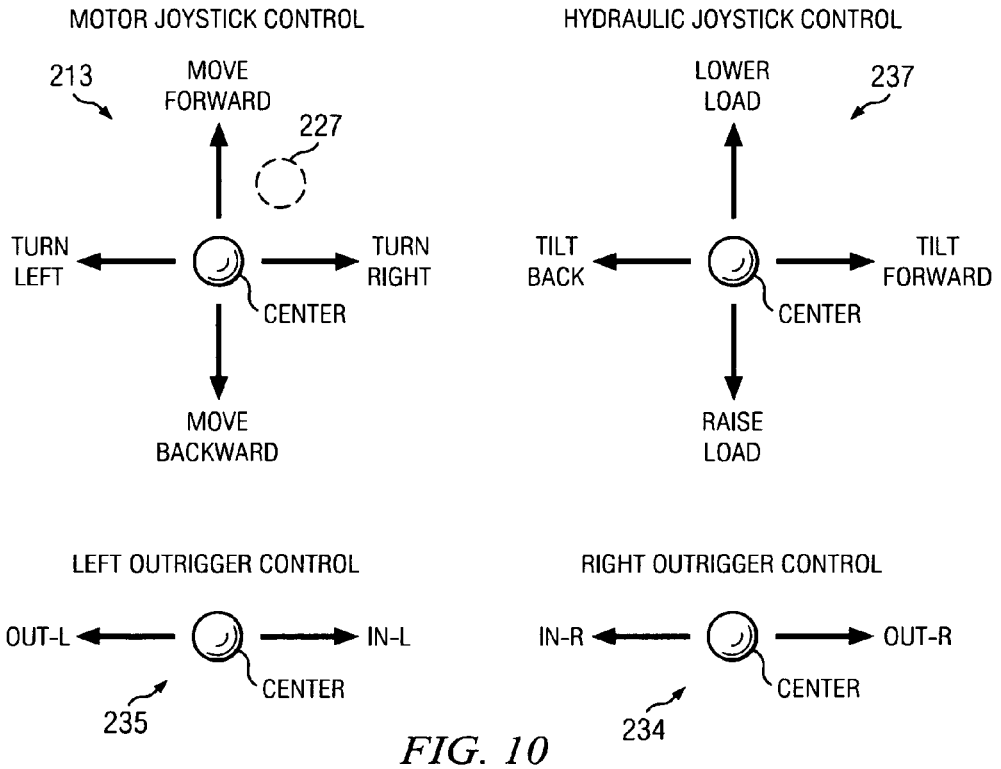
FIG. 10 is a pictorial diagram of the motor joystick control, hydraulic joystick control and outrigger controls.

A preferred embodiment of the joystick controls and outrigger controls are described in FIG. 10 with references made to FIG. 7. Motor joystick control 213 is a proportional control capable of sensing placement of a joystick within a circle divided into quadrants by the directions "move forward", "move backward", "turn right" and "turn left" and with the motor control circuit is further capable of generating a left motor rotational speed and a right motor rotational speed, in proportion to the sensed placement within the circle to motivate the load transporter. For example, with a joystick placement at position 227, the motor joystick control is programmed to cause a forward and right turning motion of the load transporter at about half of the maximum speed.

Hydraulic joystick control 237 is a control capable of sensing placement of a joystick in one of the positions: "center", "lower load", "raise load", "tilt back", "tilt forward". Hydraulic joystick control 237 preferably operates as a five position momentary switch with the normal position at "center".

Left outrigger control 235 is a momentary control switch with three positions: a normally "central" position, an "out-L" position and an "in-L" position.

Right outrigger control 234 is a momentary control switch with three positions: a normally "central" position, an "out-R" position and an "in-R" position.

Figure 11:
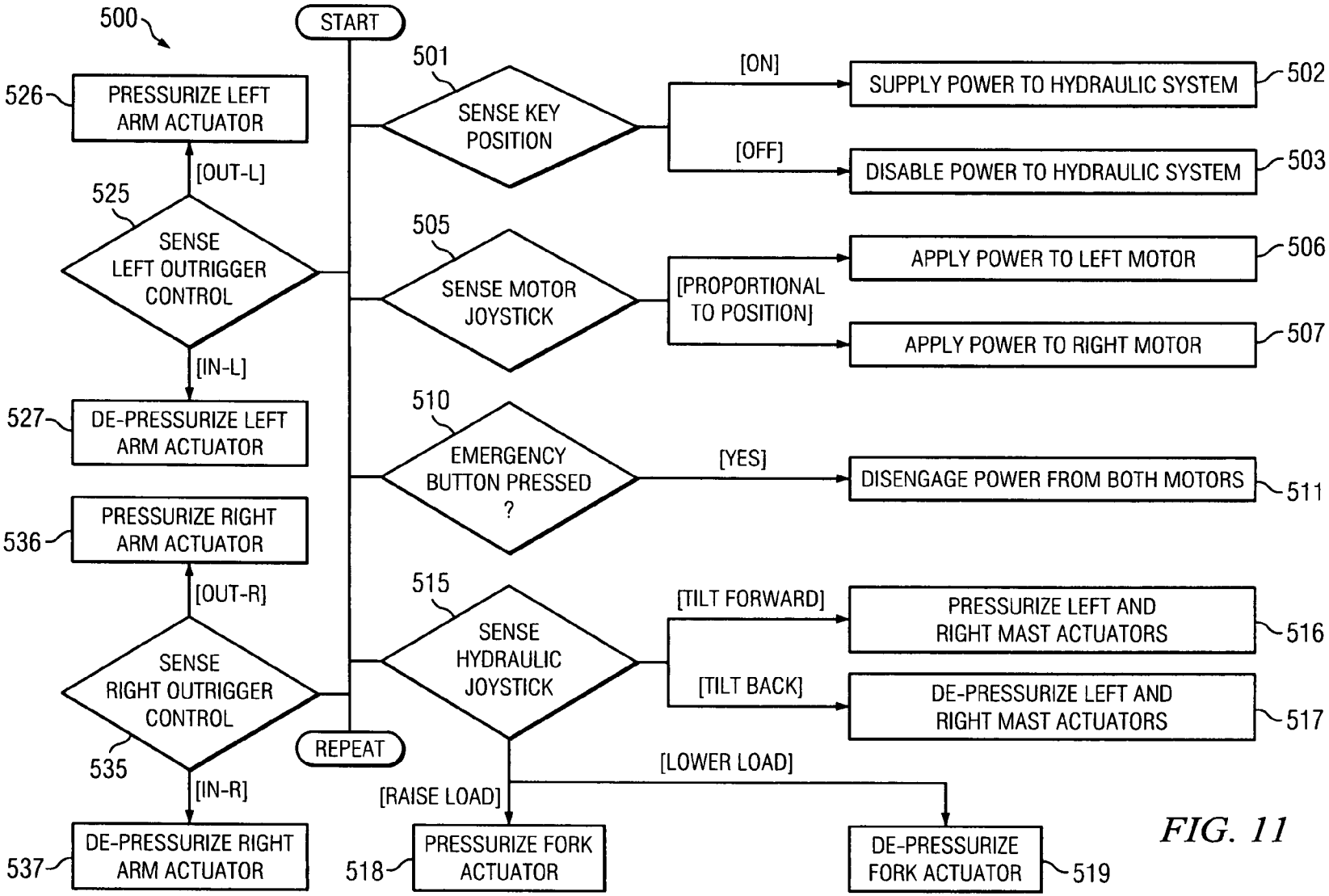
FIG. 11 is a flow chart of a preferred method of operation for the load transporter.

Referring to FIG. 11 with further reference to FIGS. 10 and 7, control of the load transporter will be described. Actuation of the keyed power switch enables the hydraulic functions of the load transporter. Control process 500 starts at step 501, wherein keyed power switch is sensed and when the keyed power switch is turned on, power is supplied to the hydraulic control circuits at step 502. When the keyed power switch is turned off, power is disabled for the hydraulic control circuits at step 503.

Note that the motor control functions are separated from the hydraulic control functions of the load transporter. When keyed power is turned off to the hydraulic control circuits, the hydraulic actuators are "locked" into position while the motor control functions remain powered and enabled, providing added safety to the rider and stability of the load during transport. For example, the rider while operating the motor controller accidentally bumps the hydraulic controller. If keyed power is turned off, then no change in the hydraulic actuator states will occur as a result of the bump. If the hydraulic controller is bumped without the keyed power safety feature, the front arms could extend while motivating the load transporter through a narrow passageway or a load could be destabilized and dropped.

At step 505 the motor joystick position is sensed by the motor control circuit and at steps 506 and 507, power is applied to the left and right wheel motors in proportion to the joystick position. For example, if the joystick is fully in the "move forward" position, the left and right motor speeds are adjusted to be about equal at $+S_F$ by the motor control circuit; if the joystick is fully in the "move backward" position, the left and right motor speeds are adjusted to be about equal at $-S_B$ by the motor control circuit; if the joystick is fully in the "turn right" position, the right motor speed is adjusted to about $+S_F$ and the left motor speed is adjusted to $-S_B$ by the motor control circuit. To illustrate the proportional control, if the joystick is in position 227, the right motor speed is adjusted to about $+\frac{2}{3} S_F$ and the left motor speed is reduced to about $+\frac{1}{3} S_F$, causing a rightward turn of the load transporter while moving generally forward.

In one aspect of the preferred embodiment, it is understood that the load transporter may execute a "zero-turn", that is, caused to rotate in position, clockwise when the joystick is placed fully in the "turn right" or counterclockwise when fully in the "turn left" position, thereby increasing its maneuverability in especially difficult conditions and small storage areas such as ramps, doorways, aisles and walk-in coolers.

At step 510, the emergency stop button is sensed. If at any time during operation, the emergency stop button is depressed, power is disengaged from both wheel motors in step 511. In another preferred embodiment, electric brakes are supplied in each motor assembly, which are engaged upon sensing when the emergency stop button is depressed and when each of the motor joysticks is placed in its central position.

To stabilize a load from side to side, the left and right front arms are extended using the left and right outrigger controls to send an electrical signal to directional valves 273 and 274.

According to step 525 the left outrigger control 235 is sensed by the hydraulic control circuit. When left outrigger control 235 is in the "center" position, directional valve 274 is in the "0" state according to the hydraulic control circuit wherein the left front arm remains in its current position. At step 526, when left outrigger control 235 is in the "out-L" position, directional valve 274 is placed in the "a" state by the hydraulic control circuit wherein the left arm actuator is pressurized to move it outward. At step 527, when left outrigger control 235 is in the "in-L" position, directional valve 274 is placed in the "b" state by the hydraulic control circuit wherein the left arm actuator is pressurized to move it inward.

According to step 535 the right outrigger control 234 is sensed by the hydraulic control circuit. When right outrigger control 234 is in the "center" position, directional valve 273 is in the "0" state according to the hydraulic control circuit wherein the right front arm remains in its current position. At step 536, when right outrigger control 234 is in the "out-R" position, directional valve 273 is placed in the "a" state by the hydraulic control circuit wherein the right arm actuator is pressurized to move it outward. At step 537, when right outrigger control 234 is in the "in-R" position, directional valve 273 is placed in the "b" state by the hydraulic control circuit wherein the right arm actuator is pressurized to move it inward.

In step 515, the hydraulic joystick position is sensed by the hydraulic control circuit. When the hydraulic joystick is in the "center" position, directional valves 263 and 283 are in state "0" according to the hydraulic control circuit wherein the tilt does not change and the fork position does not change. At step 518, when hydraulic joystick control 237 is in the "raise load" position, directional valve 283 is placed in the "a" state by the hydraulic control circuit wherein the fork actuator is pressurized and moves upward. At step 519, when hydraulic joystick control 237 is in the "lower load" position, directional valve 283 is placed in the "b" state by the hydraulic control circuit wherein the fork actuator is de-pressurized and moves downward. At step 516, when hydraulic joystick control 237 is in the "tilt forward" position, directional valve 263 is placed in the "a" state by the hydraulic control circuit wherein the mast actuators are pressurized so as to move the top of the mast forward. At step 517, when hydraulic joystick control 237 is in the "tilt backward" position, directional valve 263 is placed in the "b" state by the hydraulic control circuit wherein the mast actuators are pressurized so as to rotate the top of the mast backward. Stabilizing the load by tilting the mast allows the operator to adjust for walkway inclines and to adjust for stairs.

Control process 500 repeats steps 501, 505, 510, 515, 525 and 535 to control the load transporter.

In another embodiment, the motor control functions relating to steps 506 and 507 can be programmed and recalled for a variety of automated functions using the microcontroller and memory of the motor controller unit.

In an alternate embodiment, an automatic stabilizing mode may be enabled by including a horizontal sensing unit in the hydraulic control panel to sense a tilt angle of the mast required to bring the center of gravity of a load into stability. The controls circuit automatically controls the mast tilt based on the sensed tilt angle by sending signals to the directional valve 263.

The left and right outrigger controls are preferably extended to stabilize a load when it is at a high position on the mast. When the load is positioned lower and closer or between the front arms, the center of gravity is correspondingly lowered; the left and right front arms are contracted to narrow the effective width of the transporter to transport the load through narrow doorways and aisles. To stabilize the load from front to back while moving the load transporter up or down an incline, the tilt of the mast assembly is changed using the hydraulic joystick control.

Figure 12:
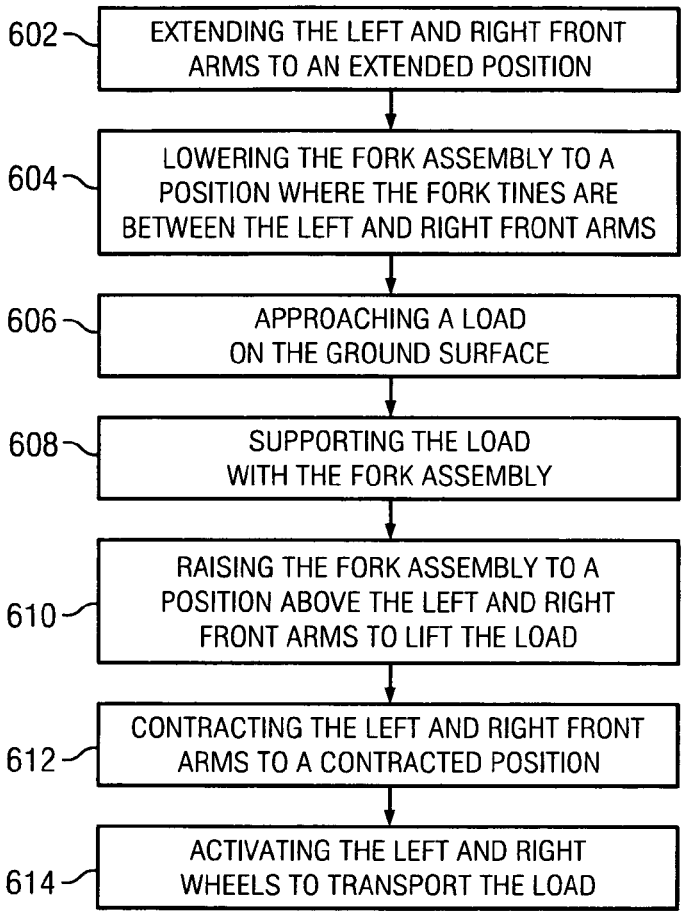
FIG. 12 is a flow chart of a preferred method of lifting a load.

A preferred method of operation to lift a load is presented in the flowchart of FIG. 12. Beginning with step 602, the left and right front arms are moved to an extended position via the left and right outrigger controls to actuate the left and right arm actuators. In step 604, the fork assembly is lowered, via the hydraulic joystick control, to a position where the fork tines are at or near the ground level, below and between the left and right arms. At step 606 the load transporter is moved forward using the motor joystick control, to engage the fork tines with a load at a first position situated at or near the ground surface. At step 608, the load transporter supports the load by raising the fork assembly to lift the load, using the hydraulic joystick control to control the fork actuator. At step 610, the fork assembly is further raised whereby the load is positioned above the left and right arms. At step 612, the left and right front arms are moved to a contracted position via the left and right outrigger controls controlling the left and right arm actuators. At step 614, the left and right wheels are activated to move the load transporter and thereby transport the load from the first position to a second position. Adjusting the width of the transporter by extending and retracting the front arms allows the operator to navigate confined spaces such as doorways and aisles, while maximizing load stability during loading and unloading.

In an alternate embodiment, the load (e.g. pallet) is lowered after step 612 to rest on the contracted front arms, where the load is then securely transported from one location to another as in the remaining steps.

FIGS. 9A, 9B, 9C, 9D, 9E and 9F show various views of a preferred embodiment vehicle mount for carrying the load transporter. Vehicle mount includes a lift frame 310 movably attached to vehicle mount 312 to which enclosure 301 is further attached. Vehicle mount 312 is affixed onto an existing vehicle 300 to house load transporter 302. Two hand truck mounts 303 are affixed on either side of the rear enclosure and serve to support the rear enclosure. The rear enclosure includes a cover for protecting the load transporter from damage due to exposure to the elements and traffic hazards.

Figure 9A:
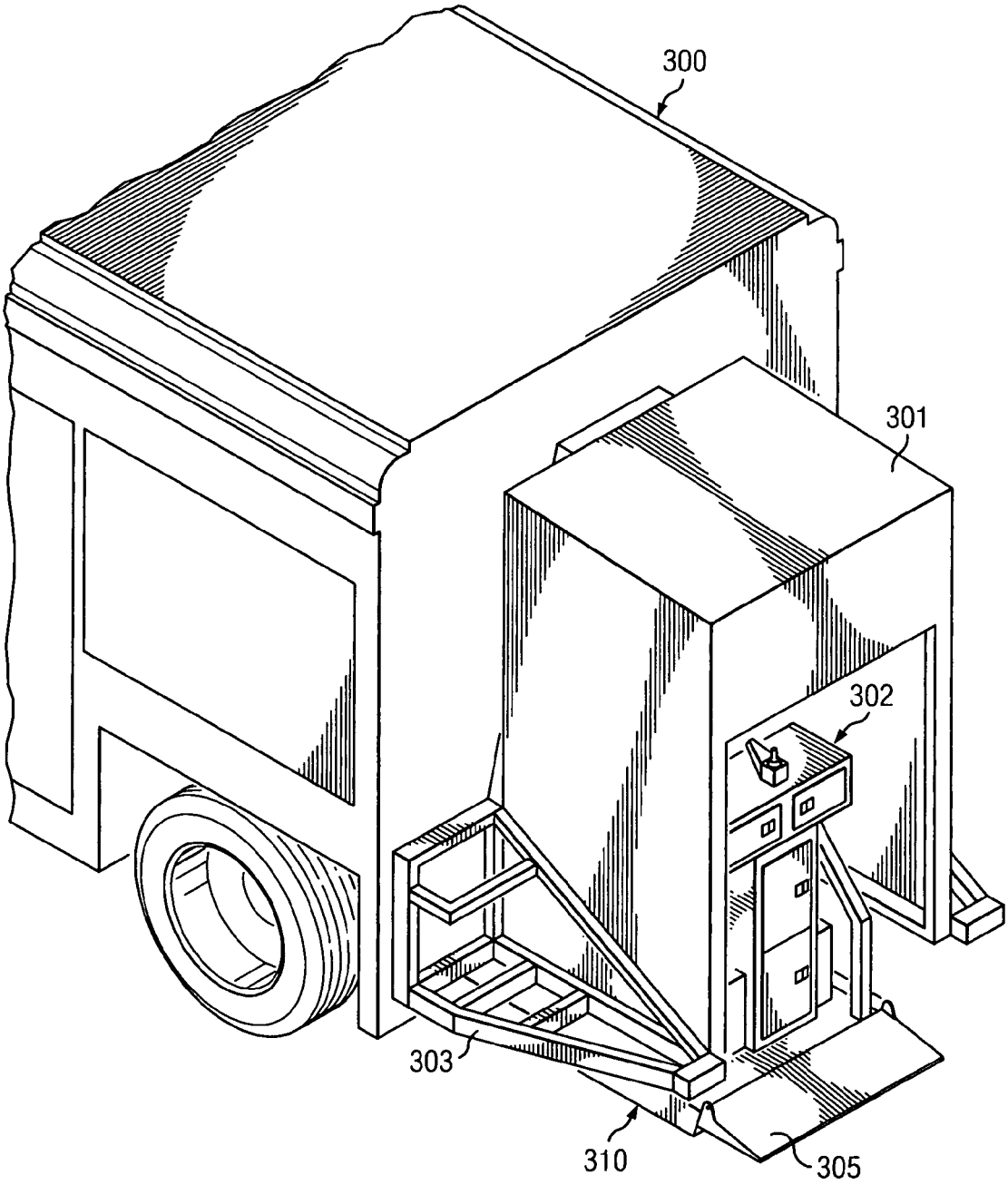
FIGS. 9A, 9B, 9C, 9D, 9E and 9F provide perspective views of a load transporter carrier assembly attached to a product trailer.
Figure 9B:
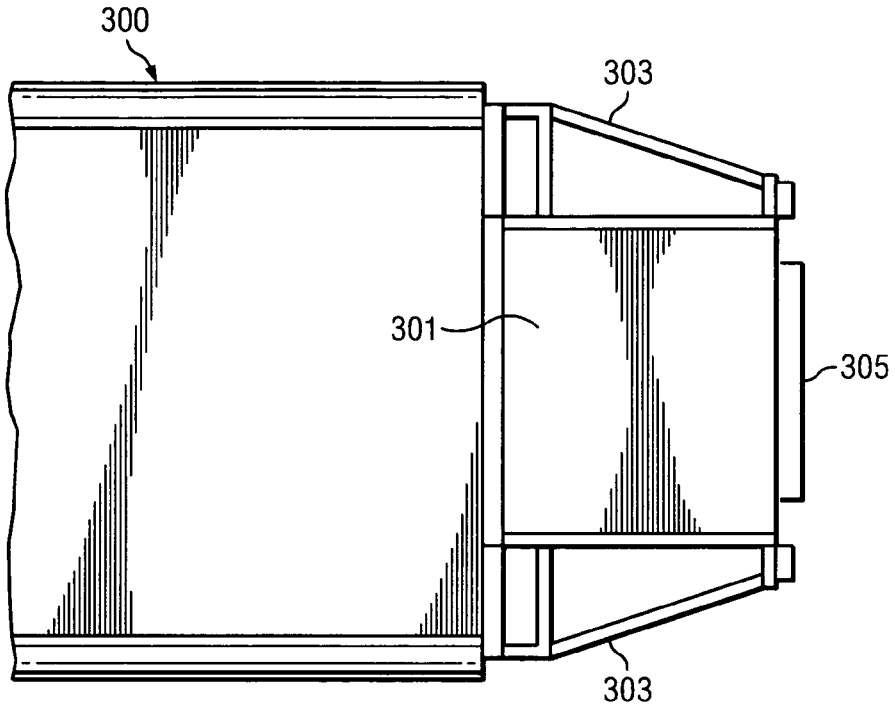
Figure 9C:
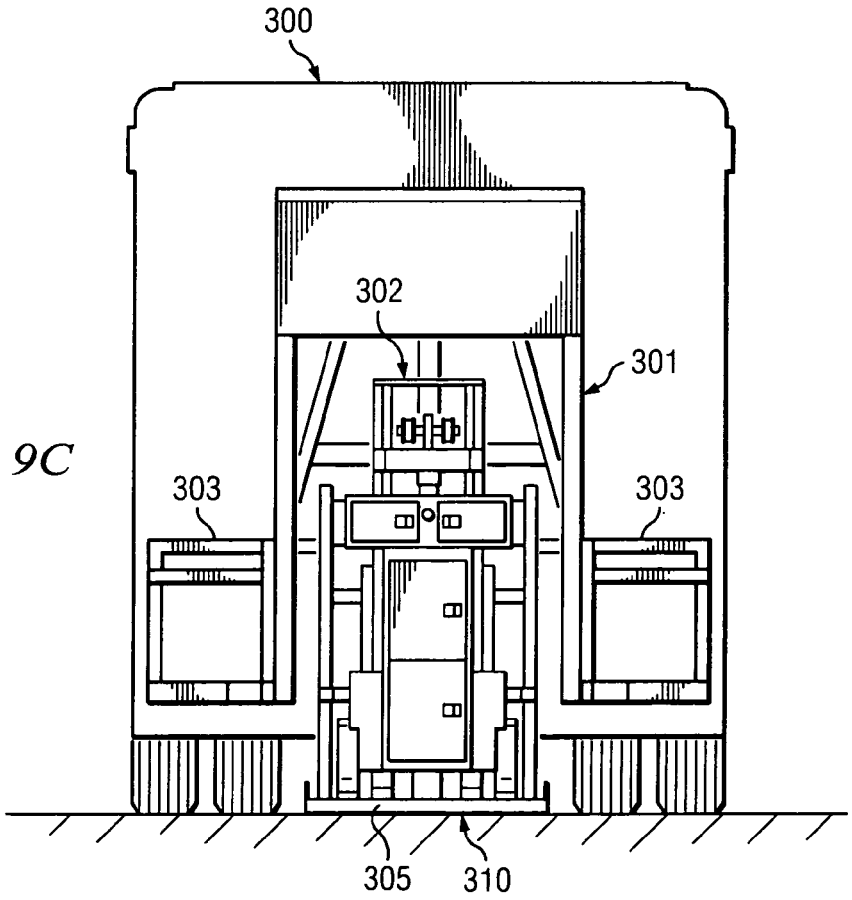
Figure 9D:
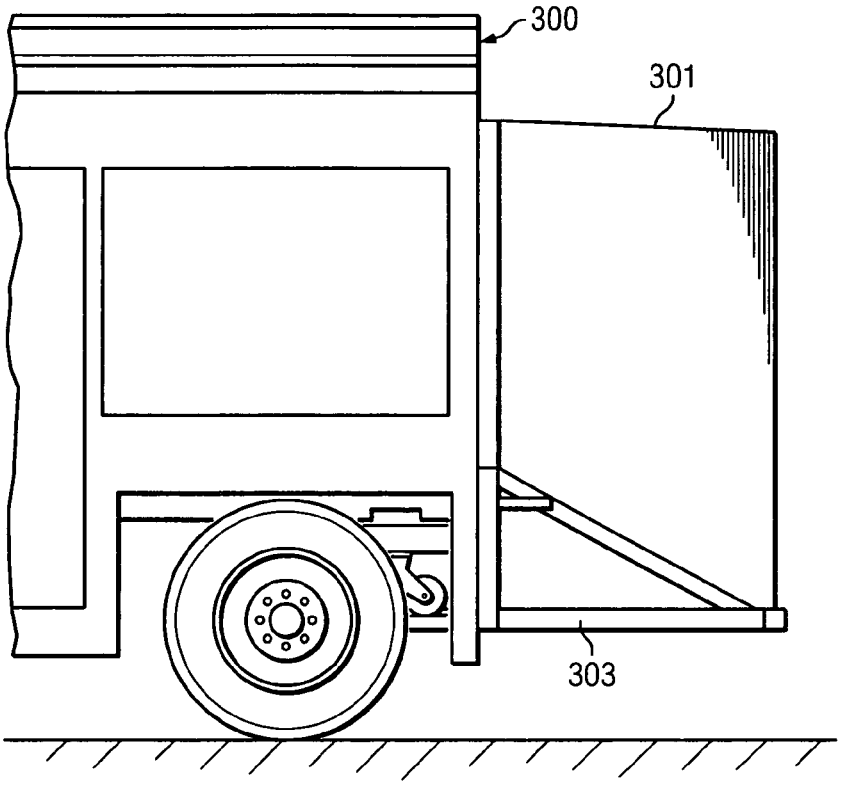
Figure 9E:
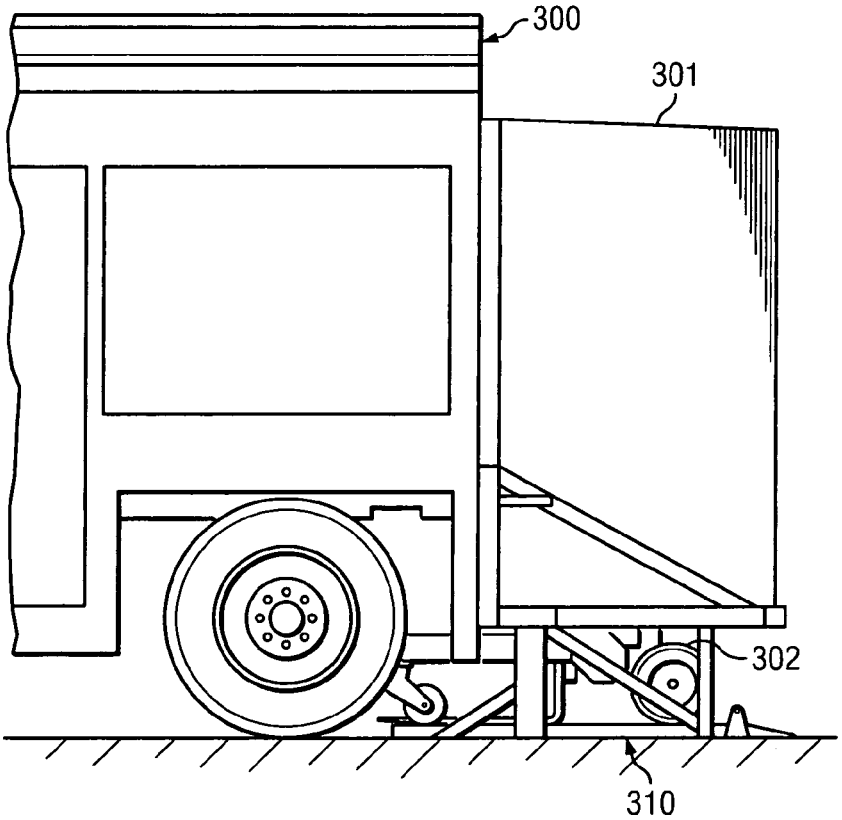
Figure 9F:
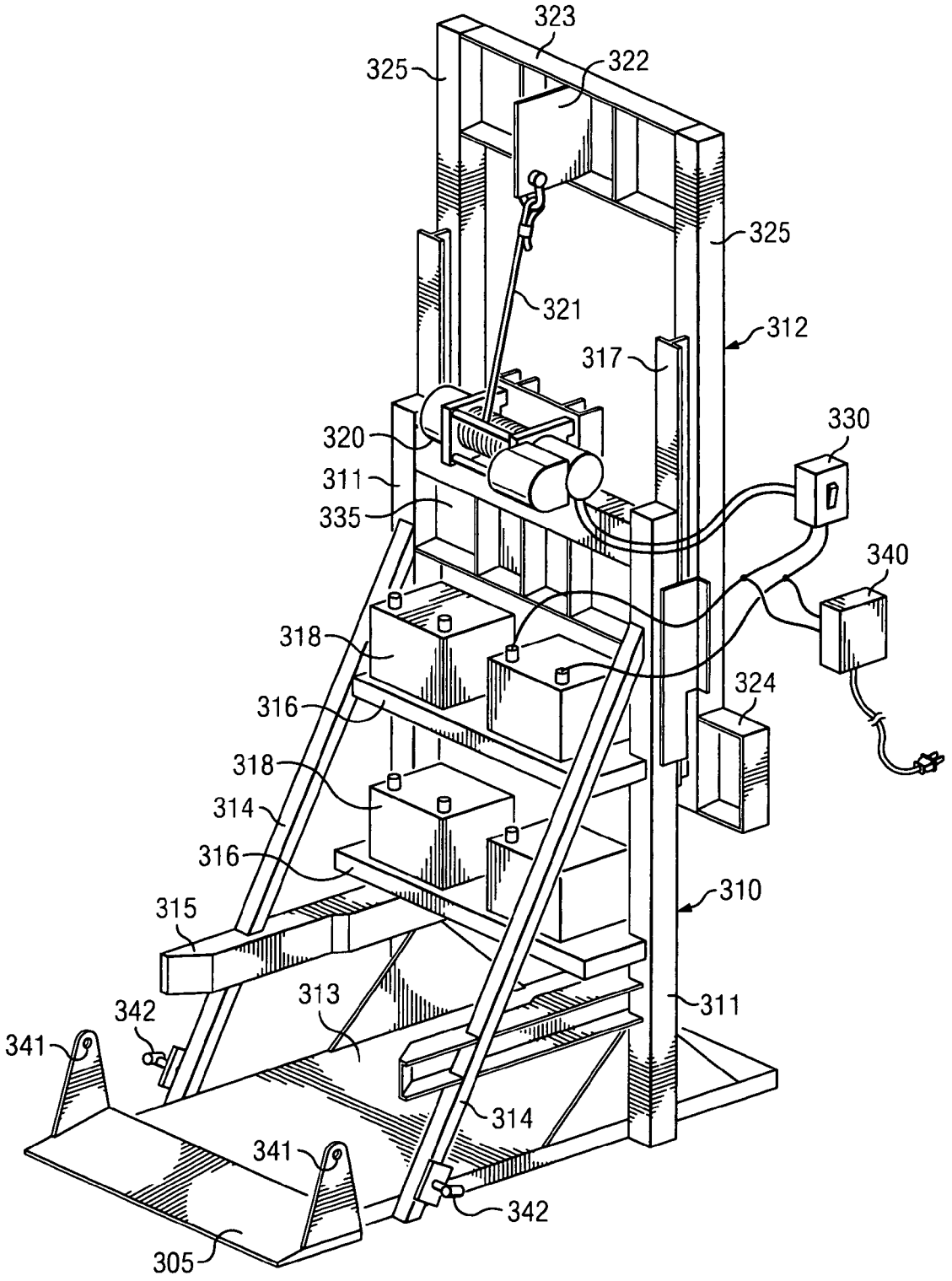

FIG. 9F shows the detail of the vehicle mount. Lift frame 310 comprises a pair of vertical members attached to a lower platform 313, a frame crossmember 335 and a set of battery shelves connecting pair of vertical members 311. Lift frame 310 further comprises a pair of stabilizing braces 314 connecting pair of vertical members 311 to lower platform 313. A pair of guides 315 are attached to the pair of stabilizing braces 314. A lift ramp 305 is rotatably attached to lift frame 310.

Vehicle mount 312 comprises an upper crossmember 323 and a lower crossmember 324 welded to a pair of vertical members 325. A lift plate 322 is attached to the upper crossmember 323. Lift frame 310 is attached to vehicle mount 312 with a pair of slides 317 attached to the pair of vertical members 325, the pair of slides supporting translation of the lift frame with respect to the vehicle mount. A cable 321 is connected between lift plate 322 and a winch 320 which is affixed to lift frame 310. Winch 320 is powered by a set of batteries 318 connected through a control 330. Cable 321 is preferably a ⅜ inch wire rope. A charging regulator 340 is connected to set of batteries 318 for charging the load transporter while in the vehicle mount. Set of batteries 318 are further connected to the vehicle charging system to allow for charging while the vehicle is operating. Control 330 and charging regulator 340 are suitably mounted on enclosure 301.

A set of mechanical latches secures the lift frame and the lift ramp 305 in a locked position suitable for travel. A mechanical latch for the frame is positioned to be manually operated to latch the lift frame into an up position. The mechanical latch is manually released to allow for unloading.

A mechanical latch for the lift ramp is preferably a set of wing bolts 342 inserted through holes 341 of the lift ramp after the lift ramp is rotated.

In operation, lift frame 310 and lift ramp 305 are lowered to ground level using control 330 and winch 320. Load transporter 302 is driven by an operator over lift ramp 305 and onto lift frame 310. The operator dismounts load transporter 302, then lifts and latches the rear step of the load transporter as in FIGS. 9A, 9C and 9E. The operator then causes the lift frame to move up and off of the ground into a travel position using control 330 and winch as indicated in FIG. 9D. Additional hand trucks, if used, are removed from and replaced to hand truck mounts 303. Pair of guides 315 aid in positioning the load transporter.

After the load transporter is securely aboard the vehicle mount, and the mechanical latches are latched, the load transporter is electrically connected to charging regulator 340 which provides a high amperage rapid refresh charge to the on-board batteries of the load transporter. Furthermore, the charging regulator 340 includes an AC mains connection and charging circuitry to allow overnight charging of both the load transporter batteries and the vehicle mount batteries.

Figure 13:
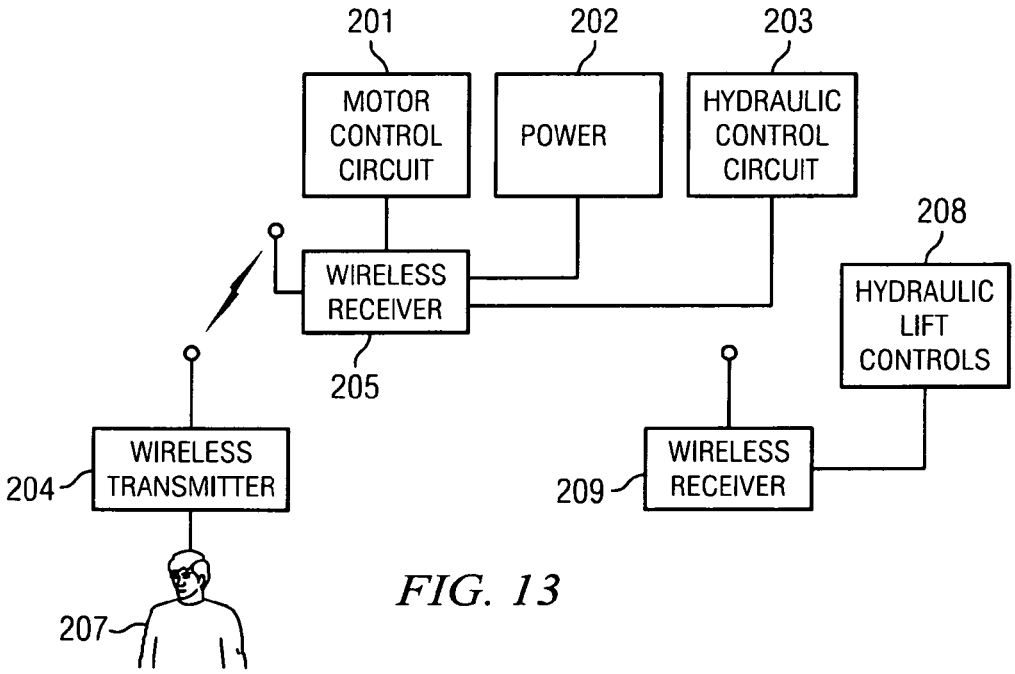
FIG. 13 is a block diagram depicting an alternate embodiment of the load transporter control circuit incorporating wireless controls.

In FIG. 13, an alternate embodiment control system for the load transporter. Motor control circuit 201 and hydraulic control circuit 203 are connected to a wireless receiver unit 205 which is powered by power circuit 202. Wireless receiver unit 205 is programmed to receive a set of wireless commands embedded in wireless signals generated by wireless transmitter unit 204. Wireless transmitter unit 204, includes a power source such as a DC battery, at least one joystick control and a plurality of switches to allow operator 207 to mimic the behavior of the first and second joysticks as well as the outrigger controls and power on/off functions. Wireless transmitter unit 204 is programmed to generate the set of wireless commands based on operator 207 behavior. Motor control circuit 201 and hydraulic control circuit 203 may be operated from the on-board controls or via the wireless receiver. Upon reception of a wireless command, the wireless receiver is further configured to interpret the wireless command, adjust the state of the motor system or hydraulic system according, and provide an electrical signal representing any change of state to the motor control circuit or the hydraulic control circuit as appropriate.

In a related embodiment, second wireless receiver 209 is electrically connected to hydraulic lift controls 208 for the hydraulic lift frame. In operation, the operator may thus control the load transporter and the vehicle mount without the necessity of climbing aboard the load transporter or the vehicle.

The specifications and description described herein are not intended to limit the invention, but to simply show a preferred embodiment in which the invention may be realized. Other embodiments may be conceived, for example, having differing dimensional characteristics, having different pivot locations for the mast assembly, having a different mechanism for telescoping the front arms or mast assembly, or having a different means of motorizing the load transporter.

The invention claimed is:

1. A reconfigurable transporter for a load comprising:

a frame;

a first lateral stabilizer, movably attached to the frame;

a first actuator, connected to the frame and the first lateral stabilizer, whereby the first lateral stabilizer is moved by activation of the first actuator between a first retracted position and a first extended position;

a second lateral stabilizer, movably attached to the frame;

a second actuator, connected to the frame and the second lateral stabilizer, whereby the second stabilizer is moved by activation of the second actuator between a second retracted position and a second extended position;

a first guide wheel operably attached to the first lateral stabilizer;

a second guide wheel operably attached to the second lateral stabilizer;

a first drive motor, having a first drive wheel, attached to the frame;

a second drive motor, having a second drive wheel, attached to the frame;

a mast assembly, including a support mast, pivotally attached to the frame between the first and second guide wheels, and the first and second drive wheels;

a telescoping mast, constrained to move adjacent to the support mast;

a pulley assembly rotatably fastened to the telescoping mast;

a fork assembly slidably attached to the telescoping mast;

a chain traversing the pulley assembly and fixed to the fork assembly and the support mast;

a third actuator, fixed with respect to the support mast and attached to the pulley assembly, whereby the telescoping mast is extended by activation of the third actuator and the fork assembly is moved between at least a first transport position and a second transport position;

a fourth actuator, attached to the frame and to the support mast, whereby the support mast is tilted with respect to the frame;

a hydraulic system, operatively connected to the first actuator, the second actuator, the third actuator and the fourth actuator;

whereby the fork carriage when in the first transport position is between the first lateral stabilizer and the second lateral stabilizer when the first lateral stabilizer is in the first extended position and the second lateral stabilizer is in the second extended position;

whereby the fork carriage when in the second transport position is above the first lateral stabilizer and the second lateral stabilizer when the first lateral stabilizer is in the first retracted position and the second lateral stabilizer is in the second retracted position;

a first controller, operatively connected to the first drive motor, the second drive motor and a power supply, whereby the first drive motor and the second drive motor are activated according to a first set of control signals to move the reconfigurable load transporter;

a second controller, operatively connected to the hydraulic system, whereby the first actuator, the second actuator, the third actuator and the fourth actuator are activated according to a second set of control signals to position the load; and wherein the power supply includes a battery.

2. The reconfigurable transporter of claim 1 wherein the battery is an absorbed glass matt battery.

3. A reconfigurable transporter for a load comprising:

a frame;

a first lateral stabilizer, movably attached to the frame;

a first actuator, connected to the frame and the first lateral stabilizer, whereby the first lateral stabilizer is moved by activation of the first actuator between a first retracted position and a first extended position;

a second lateral stabilizer, movably attached to the frame;

a second actuator, connected to the frame and the second lateral stabilizer, whereby the second stabilizer is moved by activation of the second actuator between a second retracted position and a second extended position;

a first guide wheel operably attached to the first lateral stabilizer;

a second guide wheel operably attached to the second lateral stabilizer;

a first drive motor, having a first drive wheel, attached to the frame;

a second drive motor, having a second drive wheel, attached to the frame;

a mast assembly, including a support mast, pivotally attached to the frame between the first and second guide wheels, and the first and second drive wheels;

a telescoping mast, constrained to move adjacent to the support mast;

a pulley assembly rotatably fastened to the telescoping mast;

a fork assembly slidably attached to the telescoping mast;

a chain traversing the pulley assembly and fixed to the fork assembly and the support mast;

a third actuator, fixed with respect to the support mast and attached to the pulley assembly, whereby the telescoping mast is extended by activation of the third actuator and the fork assembly is moved between at least a first transport position and a second transport position;

a fourth actuator, attached to the frame and to the support mast, whereby the support mast is tilted with respect to the frame;

a hydraulic system, operatively connected to the first actuator, the second actuator, the third actuator and the fourth actuator;

whereby the fork carriage when in the first transport position is between the first lateral stabilizer and the second lateral stabilizer when the first lateral stabilizer is in the first extended position and the second lateral stabilizer is in the second extended position;

whereby the fork carriage when in the second transport position is above the first lateral stabilizer and the second lateral stabilizer when the first lateral stabilizer is in the first retracted position and the second lateral stabilizer is in the second retracted position;

a first controller, operatively connected to the first drive motor, the second drive motor and a power supply, whereby the first drive motor and the second drive motor are activated according to a first set of control signals to move the reconfigurable load transporter;

a second controller, operatively connected to the hydraulic system, whereby the first actuator, the second actuator, the third actuator and the fourth actuator are activated according to a second set of control signals to position the load; and, wherein the fork carriage further comprises at least one pivotally attached fork tine.

4. A reconfigurable transporter for a load comprising:

a frame;

a first lateral stabilizer, movably attached to the frame;

a first actuator, connected to the frame and the first lateral stabilizer, whereby the first lateral stabilizer is moved by activation of the first actuator between a first retracted position and a first extended position;

a second lateral stabilizer, movably attached to the frame;

a second actuator, connected to the frame and the second lateral stabilizer, whereby the second stabilizer is moved by activation of the second actuator between a second retracted position and a second extended position;

a first guide wheel operably attached to the first lateral stabilizer;

a second guide wheel operably attached to the second lateral stabilizer;

a first drive motor, having a first drive wheel, attached to the frame;

a second drive motor, having a second drive wheel, attached to the frame;

a mast assembly, including a support mast, pivotally attached to the frame between the first and second guide wheels, and the first and second drive wheels;

a telescoping mast, constrained to move adjacent to the support mast;

a pulley assembly rotatably fastened to the telescoping mast;

a fork assembly slidably attached to the telescoping mast;

a chain traversing the pulley assembly and fixed to the fork assembly and the support mast;

a third actuator, fixed with respect to the support mast and attached to the pulley assembly, whereby the telescoping mast is extended by activation of the third actuator and the fork assembly is moved between at least a first transport position and a second transport position;

a fourth actuator, attached to the frame and to the support mast, whereby the support mast is tilted with respect to the frame;

a hydraulic system, operatively connected to the first actuator, the second actuator, the third actuator and the fourth actuator;

whereby the fork carriage when in the first transport position is between the first lateral stabilizer and the second lateral stabilizer when the first lateral stabilizer is in the first extended position and the second lateral stabilizer is in the second extended position;

whereby the fork carriage when in the second transport position is above the first lateral stabilizer and the second lateral stabilizer when the first lateral stabilizer is in the first retracted position and the second lateral stabilizer is in the second retracted position;

a first controller, operatively connected to the first drive motor, the second drive motor and a power supply, whereby the first drive motor and the second drive motor are activated according to a first set of control signals to move the reconfigurable load transporter;

a second controller, operatively connected to the hydraulic system, whereby the first actuator, the second actuator, the third actuator and the fourth actuator are activated according to a second set of control signals to position the load;

wherein the first set of control signals includes a first velocity signal to the first drive motor and a second velocity signal to the second drive motor; and, wherein the second velocity signal is of opposite polarity to the first velocity drive signal enabling the reconfigurable transporter to rotate in position.

* * * * *